US012391420B2

(12) United States Patent
Bellmore et al.

(10) Patent No.: US 12,391,420 B2
(45) Date of Patent: Aug. 19, 2025

(54) FILLER ASSEMBLY AND METHOD OF FILLING A POUCH

(71) Applicant: Scholle IPN Corporation, Northlake, IL (US)

(72) Inventors: David Bellmore, Bellaire, MI (US); Sean Fitzgerald, West Dundee, IL (US)

(73) Assignee: SCHOLLE IPN CORPORATION, Northlake, IL (US)

( * ) Notice: Subject to any disclaimer, the term of this patent is extended or adjusted under 35 U.S.C. 154(b) by 0 days.

(21) Appl. No.: 18/731,167

(22) Filed: May 31, 2024

(65) Prior Publication Data

US 2024/0359850 A1 Oct. 31, 2024

Related U.S. Application Data

(62) Division of application No. 17/881,524, filed on Aug. 4, 2022, now Pat. No. 11,999,519.

(51) Int. Cl.

| | |
|---|---|
| ***B65B 55/02*** | (2006.01) |
| ***B65B 1/12*** | (2006.01) |
| ***B65B 1/16*** | (2006.01) |
| ***B65B 3/08*** | (2006.01) |
| ***B65B 3/14*** | (2006.01) |

(52) U.S. Cl.

CPC ..... *B65B 55/022* (2013.01); *B65B 1/12* (2013.01); *B65B 1/16* (2013.01); *B65B 3/08* (2013.01); *B65B 3/14* (2013.01)

(58) Field of Classification Search

CPC ..... B65B 39/004; B65B 3/045; B65B 3/08; B65B 3/14; B65B 55/027; B65B 1/12; B65B 1/16

See application file for complete search history.

(56) References Cited

U.S. PATENT DOCUMENTS

| | | | | |
|---|---|---|---|---|
| 3,511,022 | A * | 5/1970 | Bowen | B65B 55/027 53/512 |
| 3,514,919 | A * | 6/1970 | Ashton | B65B 55/12 53/469 |
| 3,841,946 | A * | 10/1974 | Carter | B65C 9/06 156/566 |
| 4,446,674 | A * | 5/1984 | Inada | B65B 1/34 53/502 |

(Continued)

*Primary Examiner* — Andrew M Tecco

(74) *Attorney, Agent, or Firm* — The Watson IP Group; Jovan N. Jovanovic

(57) ABSTRACT

A filler assembly comprising a pouch preheat zone, a pouch sterilization zone, and a pouch flush zone. The preheat zone includes a preheat nozzle assembly having an inlet and an outlet, the outlet engageable with a pouch assembly, and a preheat vacuum nozzle assembly having an inlet engageable with a pouch assembly and an outlet attachable to a vacuum. The pouch sterilization zone includes a sterilization nozzle assembly having an inlet and an outlet, the outlet engageable with a pouch assembly, and, a sterilization vacuum nozzle assembly having an inlet engageable with a pouch assembly and an outlet attachable to a vacuum. The pouch flush zone includes a pouch flush nozzle assembly having an inlet and an outlet, the outlet engageable with a pouch assembly, and, a pouch flush vacuum nozzle assembly having an inlet engageable with a pouch assembly and an outlet attachable to a vacuum.

18 Claims, 19 Drawing Sheets

(56) References Cited

U.S. PATENT DOCUMENTS

| | | | | | |
|---|---|---|---|---|---|
| 4,969,348 | A * | 11/1990 | Clowes | B65G 33/06 | 72/425 |
| 6,070,622 | A * | 6/2000 | Rutter | B65B 55/022 | 141/2 |
| 6,253,809 | B1 * | 7/2001 | Paradies | B65B 43/60 | 141/144 |
| 6,748,984 | B2 * | 6/2004 | Hiramoto | B65G 47/846 | 141/144 |
| 11,518,560 | B1 * | 12/2022 | Orr | B65B 31/06 | |
| 11,548,665 | B2 * | 1/2023 | Wittorf | A61J 1/10 | |
| 2005/0199313 | A1 * | 9/2005 | Edwards | B65D 41/3409 | 141/114 |
| 2017/0081065 | A1 * | 3/2017 | Fitzgerald | B08B 3/022 | |
| 2020/0270003 | A1 * | 8/2020 | Wittorf | A61J 1/1462 | |
| 2021/0403304 | A1 * | 12/2021 | Hayakawa | B67C 7/0073 | |

* cited by examiner

FILLER ASSEMBLY AND METHOD OF FILLING A POUCH

CROSS-REFERENCE TO RELATED APPLICATION

The present application is a divisional of U.S. patent application Ser. No. 17/881,524 filed on Aug. 4, 2022, entitled "Filler Assembly And Method Of Filling A Pouch", the entire specification of which is hereby incorporated by reference in its entirety.

BACKGROUND OF THE DISCLOSURE

1. Field of the Disclosure

The disclosure relates in general to fillers, and more particularly, to a filler assembly configured to fill, preferably pouch assemblies with a flowable material. It is desirable that the filler assembly fill pouch assemblies in an aseptic environment within the filler assembly. Methods of filling a pouch are disclosed, as well as a mechanism and method of directing a pouch assembly through a filler assembly, as well as a nozzle assembly configuration.

2. Background Art

Flexible packaging, and the filling of flexible packaging is known in the art. Such flexible packaging typically includes a flexible bag or pouch that is filled through a rigid spout. Increasingly, the use of pouches filled with flowable material has become widespread.

Such pouches are typically filled in a filler assembly with a flowable material. Increasingly, it is desirable to fill in an aseptic environment and to minimize the use of preservatives and chemicals within the flowable material. Such fill may be a hot fill or a cold fill. There is a constant need to improve the filling process and equipment for filling packaging, and aseptic packaging, with pouch assemblies, among other types of packages.

Among other issues, such fillers often include sterilization steps. It is desirable to improve the removal of the fluids (liquids, vapors and/or gasses) that are utilized during the sterilization steps so as to minimize contamination of the flowable material with which the pouch assemblies are to be filled. Additionally, it is desirable to improve the circulation of the different fluids associated with the preparation of the pouch assemblies for filling, so as to maximize their operation within the pouch assembly. It is further desirable to improve the handling and/or movement of pouch assemblies within the filler assembly.

SUMMARY OF THE DISCLOSURE

The disclosure is directed in one aspect to a filler assembly comprising a pouch preheat zone, a pouch sterilization zone, and a pouch flush zone. The pouch preheat zone includes at least one preheat nozzle assembly having an inlet and an outlet, wherein the outlet engageable with a pouch assembly, and, at least one preheat vacuum nozzle assembly having an inlet engageable with a pouch assembly and an outlet attachable to a vacuum. The pouch sterilization zone is positioned after the pouch preheat zone and includes at least one sterilization nozzle assembly having an inlet and an outlet, wherein, the outlet engageable with a pouch assembly, and, at least one sterilization vacuum nozzle assembly having an inlet engageable with a pouch assembly and an outlet attachable to a vacuum. The pouch flush zone positioned after the pouch sterilization zone and includes at least one pouch flush nozzle assembly having an inlet and an outlet, wherein the outlet engageable with a pouch assembly, and, at least one pouch flush vacuum nozzle assembly having an inlet engageable with a pouch assembly and an outlet attachable to a vacuum. The pouch assembly is configured to traverse sequentially from the pouch preheat zone to the pouch sterilization zone, to the pouch flush zone. A vacuum is pulled on the pouch assembly in the preheat zone with the preheat vacuum nozzle prior to attachment of the pouch assembly to the at least one sterilization nozzle assembly. Additionally, a vacuum is pulled on the pouch assembly in the pouch sterilization zone with the sterilization vacuum nozzle prior to attachment of the pouch assembly to the at least one pouch flush nozzle. Additionally, a vacuum is pulled by the at least one pouch flush vacuum nozzle.

In some configurations, the at least one preheat nozzle assembly comprises at least four preheat nozzle assemblies positioned sequentially.

In some such configurations, the at least one sterilization nozzle assembly comprises at least four sterilization nozzle assemblies positioned sequentially.

In some configurations, the at least one flush nozzle assembly comprises at least four flush nozzle assemblies positioned sequentially.

In some configurations, the at least one preheat nozzle assembly comprises at least eight preheat nozzle assemblies positioned sequentially, with the pouch assembly treated by every other one of the at least eight preheat nozzle assemblies. Similarly, the at least one preheat vacuum nozzle assembly comprises at least two preheat vacuum nozzle assemblies, with the pouch assembly treated by every other one of the at least two preheat vacuum nozzle assemblies.

In some such configurations, the at least one sterilization nozzle assembly comprises at least eight sterilization nozzle assemblies positioned sequentially, with the pouch assembly treated by every other one of the at least eight sterilization nozzle assemblies. Similarly, the at least one sterilization vacuum nozzle assembly comprises at least two sterilization vacuum nozzle assemblies, with the pouch assembly treated by every other one of the at least two sterilization vacuum nozzle assemblies.

In some configurations, the at least one flush nozzle assembly comprises at least eight flush nozzle assemblies positioned sequentially, with the pouch assembly treated by every other one of the at least eight flush nozzle assemblies. Similarly, the at least one flush vacuum nozzle assembly comprises at least two flush vacuum nozzle assemblies, with the pouch assembly treated by every other one of the at least two flush vacuum nozzle assemblies.

In some configurations, the filler assembly further includes a pouch fill zone positioned after the pouch flush zone. The pouch fill zone comprising at least two pouch fill valves.

In some configurations, the filler assembly further includes a pouch cap zone positioned after the pouch fill zone. The pouch cap zone having a cap twisting assembly having at least two cap engaging bits, each coupled to a rotational actuator.

In some configurations, the filler assembly further includes a pouch fill zone positioned sequentially after the pouch flush zone, and a pouch cap zone positioned sequentially after the pouch fill zone.

In some such configurations, a pouch movement mechanism extends from the pouch preheat zone, to the pouch sterilization zone, the pouch flush zone, the pouch fill zone and the pouch cap zone. The pouch movement mechanism includes a first region and a second region. The first region includes a pair of opposed helical screws, each helical screw having a helical slot, wherein the helical slots of the pair of helical screws correspond to each other proximate a lower channel extending below and therebetween. The second region includes a first linear movement assembly, a second linear movement assembly and a linear lower channel positioned therebetween and comprising an extension of the lower channel at a second end thereof. Each linear movement assembly includes a pouch engagement member having an inner edge with receiving slots structurally configured to engage the spout assembly positioned within the linear lower channel. Each of the pouch engagement members configured to move transversely toward and away from the linear lower channel, and longitudinally toward and away from the first end of the linear lower channel.

In some configurations, the first region of the pouch movement mechanism extends across the pouch preheat zone, the pouch sterilization zone, the pouch flush zone and the pouch fill zone. Additionally, the second region of the pouch movement mechanism extends across the pouch cap zone.

In some configurations, the at least one preheat nozzle assembly includes a spout engagement portion proximate the outlet, and a circumferential sealing rim extending about an outer surface thereof structurally configured to sealingly engage a spout of the pouch assembly. At least one transverse slot traverses across the circumferential sealing rim so as to allow fluid to pass beyond the circumferential sealing rim when the circumferential sealing rim engages the spout of the pouch assembly.

In some configurations, the at least one sterilization nozzle assembly includes a spout engagement portion proximate the outlet, and a circumferential sealing rim extending about an outer surface thereof structurally configured to sealingly engage a spout of the pouch assembly. At least one transverse slot traverses across the circumferential sealing rim so as to allow fluid to pass beyond the circumferential sealing rim when the circumferential sealing rim engages the spout of the pouch assembly.

In some configurations, the at least one flush nozzle assembly includes a spout engagement portion proximate the outlet, and a circumferential sealing rim extending about an outer surface thereof structurally configured to sealingly engage a spout of the pouch assembly. At least one transverse slot traverses across the circumferential sealing rim so as to allow fluid to pass beyond the circumferential sealing rim when the circumferential sealing rim engages the spout of the pouch assembly.

In another aspect of the disclosure, the disclosure is directed to a pouch movement mechanism for a filler assembly. The pouch movement mechanism comprises a first region and a second region. The first region includes a pair of opposed helical screws, each helical screw having a helical slot, wherein the helical slots of the pair of helical screws correspond to each other proximate a lower channel extending below and therebetween. The second region includes a first linear movement assembly, a second linear movement assembly and a linear lower channel positioned therebetween and comprising an extension of the lower channel at a second end thereof. Each linear movement assembly includes a pouch engagement member having an inner edge with receiving slots structurally configured to engage the spout assembly positioned within the linear lower channel. Each of the pouch engagement members is configured to move transversely toward and away from the linear lower channel, and longitudinally toward and away from the first end of the linear lower channel.

In another aspect of the disclosure, the disclosure is directed to a nozzle assembly for use with a filler assembly to provide one of a preheat fluid, a sterilization fluid and a flush fluid. The nozzle assembly includes a first end, a second end spaced apart from the first end, a nozzle inlet, and a spout engagement portion. The nozzle inlet is proximate the first end. The spout engagement portion is proximate the second end and terminates with an outlet. The spout engagement portion further includes an outer surface, with a circumferential sealing rim extending about the outer surface and structurally configured to sealingly engage a spout of the pouch assembly. At least one transverse slot traverses across the circumferential sealing rim so as to allow fluid to pass beyond the circumferential sealing rim when the circumferential sealing rim engages the spout of the pouch assembly.

In yet another aspect of the disclosure, the disclosure is directed to a method of utilizing a filler assembly comprising the steps of: directing a pouch assembly into a pouch preheat zone; preheating the pouch assembly by directing preheated fluid into the pouch assembly through a preheat nozzle assembly; applying a vacuum to the pouch assembly after preheating with a preheat vacuum nozzle assembly; sterilizing the pouch assembly by directing sterilizing fluid into the pouch assembly through a sterilizing nozzle assembly; applying a vacuum to the pouch assembly after sterilizing with a sterilization vacuum nozzle assembly; flushing the pouch assembly by directing a flushing fluid into the pouch assembly through a flush nozzle assembly; and applying a vacuum to the pouch assembly after flushing with a flushing vacuum nozzle assembly.

In some configurations, method further comprises the steps of: allowing preheated fluid to exit the pouch assembly through an outlet of the pouch assembly during the step of preheating; allowing sterilization fluid to exit the pouch assembly through the outlet of the pouch assembly during the step of sterilizing; and allowing the flushing fluid to exit the pouch assembly through the outlet of the pouch assembly during the step of flushing.

In some configurations, the method further comprises the step of: filling the pouch assembly with a flowable material after the step of applying a vacuum to the pouch assembly after flushing with a flushing vacuum nozzle assembly.

In some configurations, the method further comprises the step of: sterilizing a cap; and applying a cap to the pouch assembly after the step of filling the pouch assembly with a flowable material.

BRIEF DESCRIPTION OF THE DRAWINGS

The disclosure will now be described with reference to the drawings wherein.

DETAILED DESCRIPTION OF THE DISCLOSURE

Figure 1:
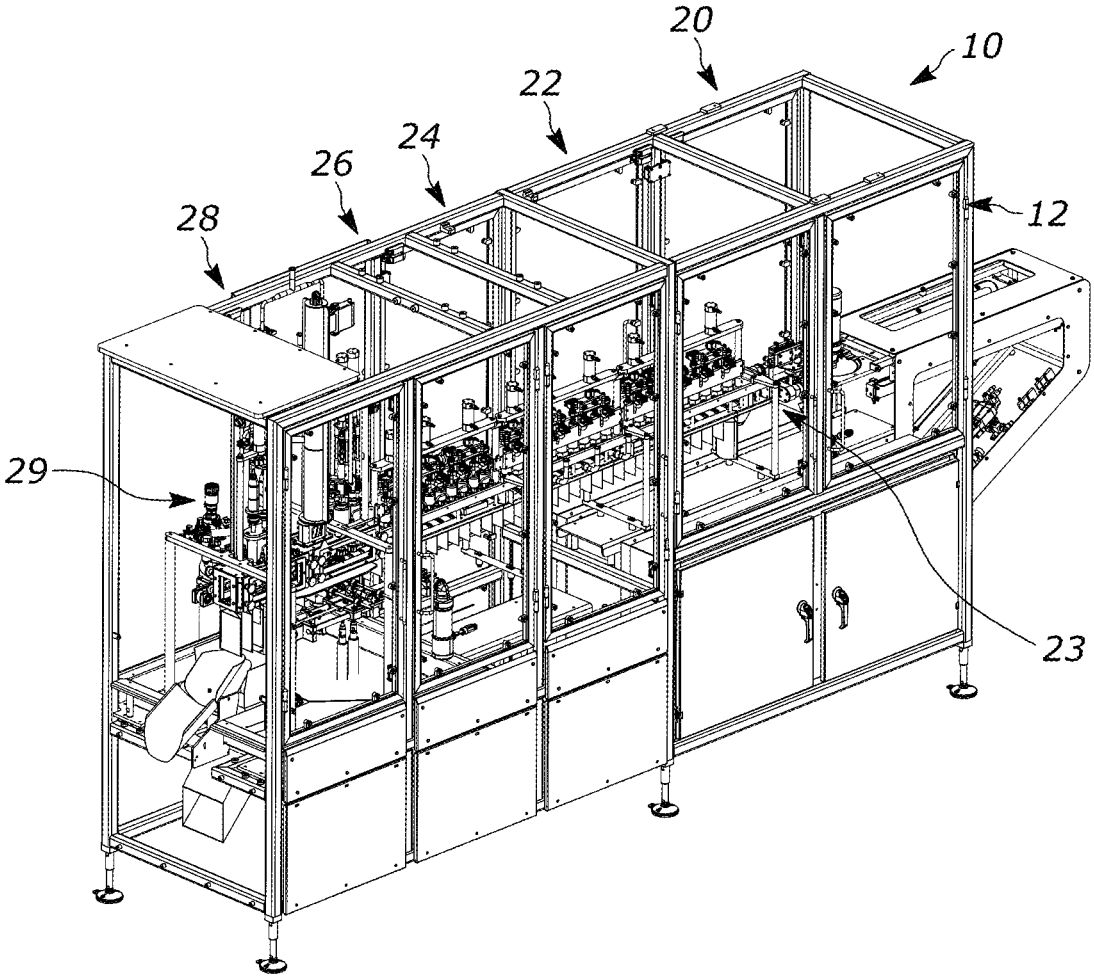
FIG. 1 of the drawings is a perspective view of the filler assembly of the present disclosure.
Figure 2:
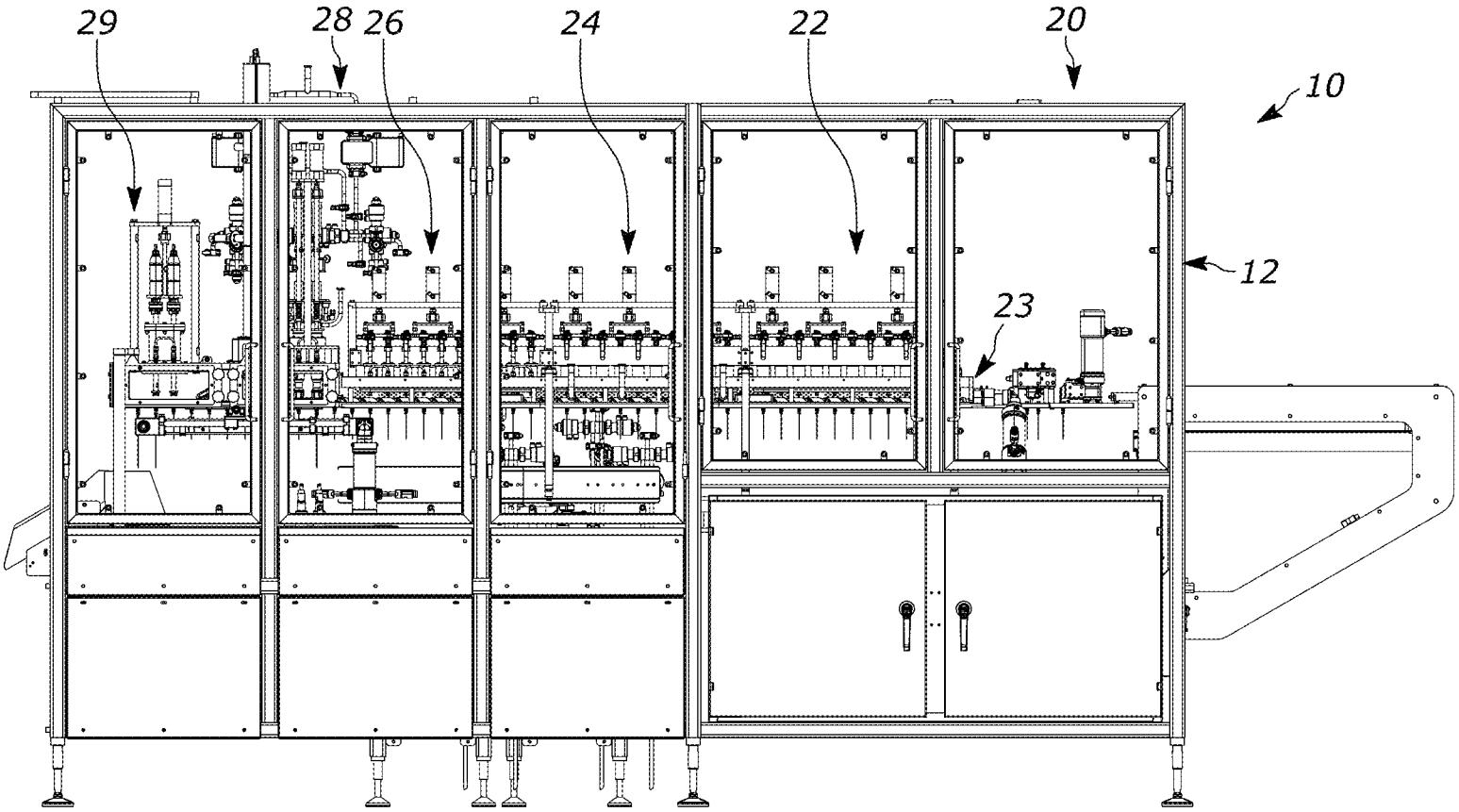
FIG. 2 of the drawings is a side elevational view of the filler assembly of the present disclosure.
Figure 3:
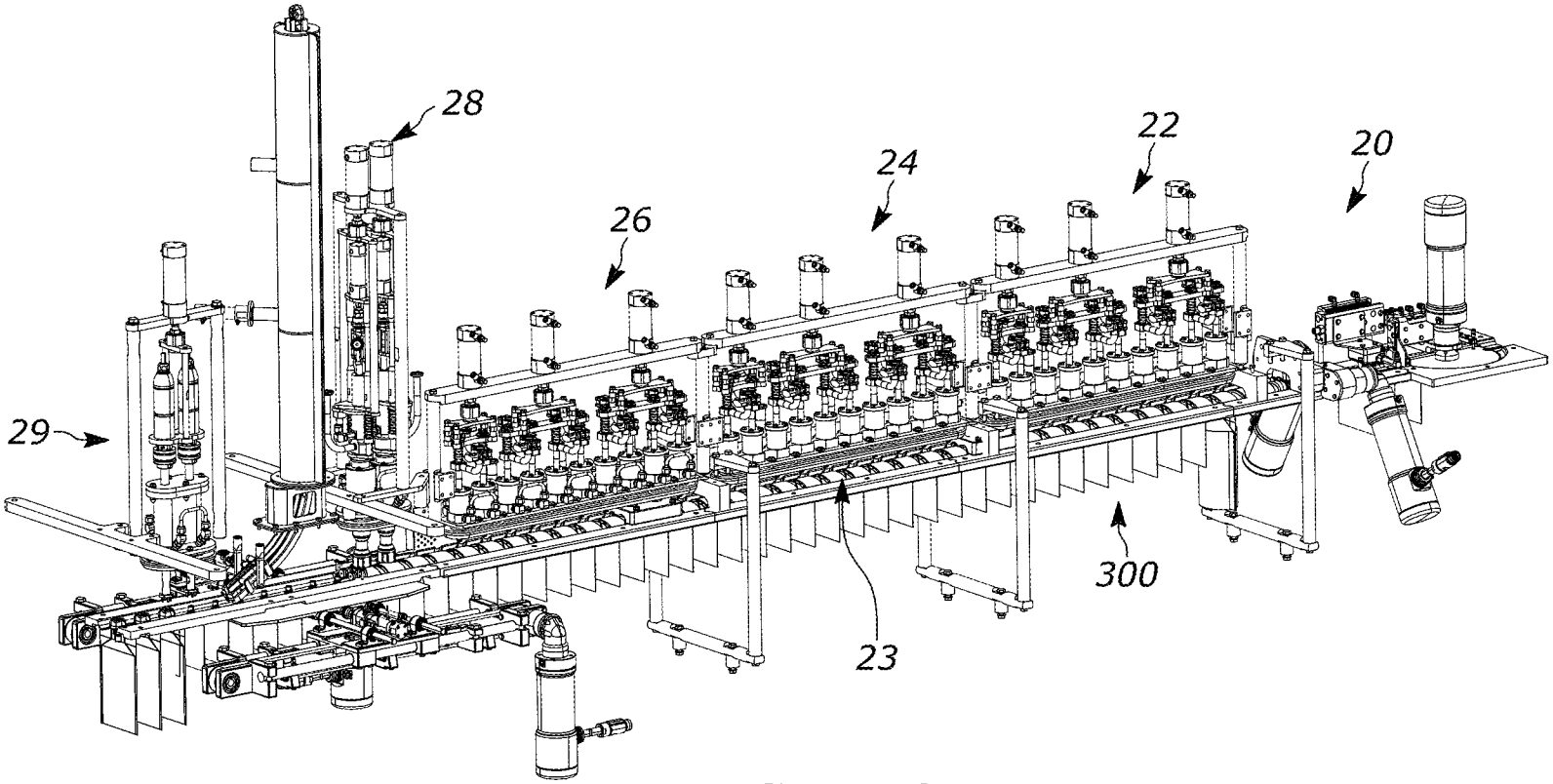
FIG. 3 of the drawings is a partial perspective view of the filler assembly with portions of the frame removed.
Figure 4:
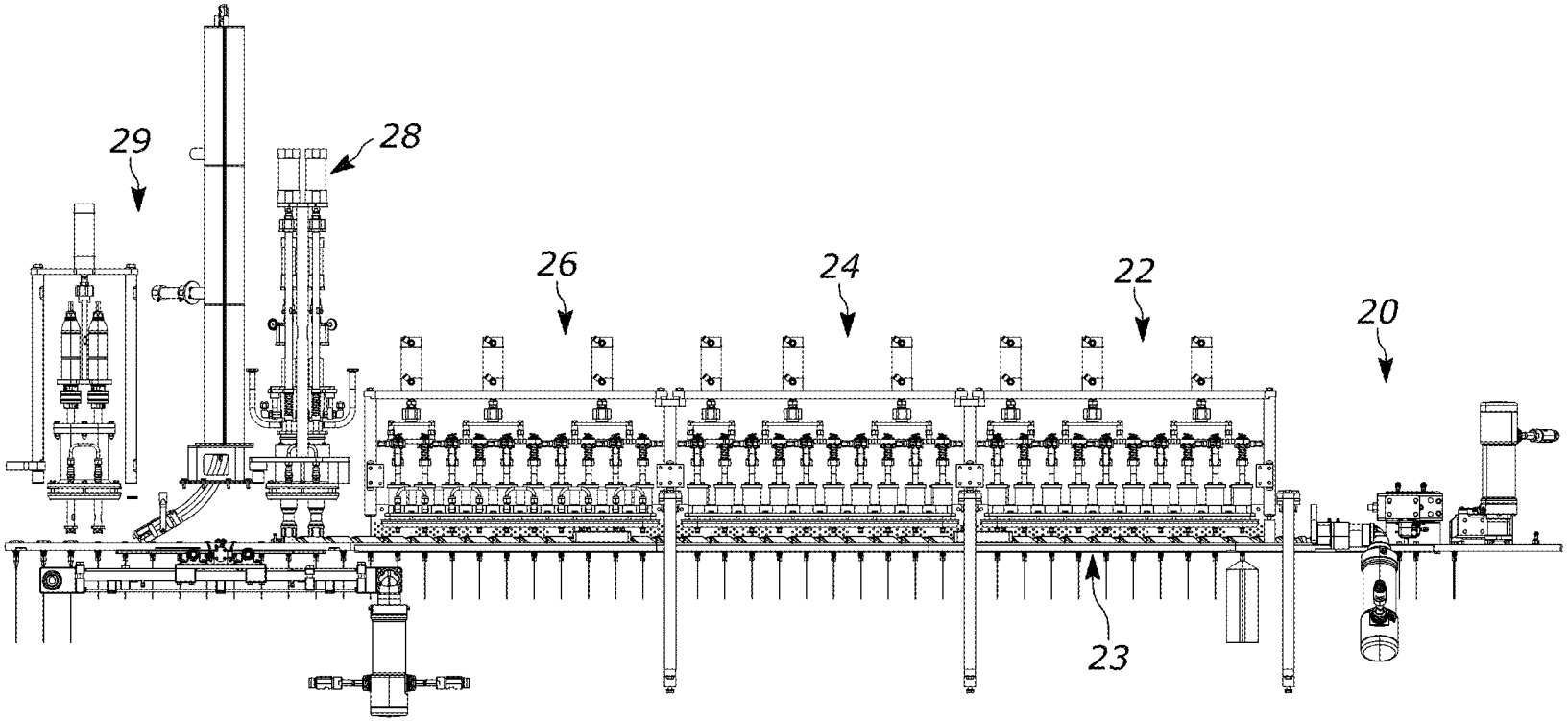
FIG. 4 of the drawings is a partial side elevational view of the filler assembly with portions of the frame removed.

While this disclosure is susceptible of embodiment in many different forms, there is shown in the drawings and described herein in detail a specific embodiment(s) with the understanding that the present disclosure is to be considered as an exemplification and is not intended to be limited to the embodiment(s) illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIGS. 1 through 4, the filler assembly according to the present disclosure is shown generally at 10. The filler assembly, while suitable for other types of containers, and not being limited to any particular type of container, can be utilized with the filling of pouch assemblies, such as pouch assembly 300, with various different flowable materials. Among other flowable material, it is contemplated that the flowable material may comprise infant and toddler foods, humus, puddings, dairy based drinks, nutritional and sports drinks, among others.

Figure 19:
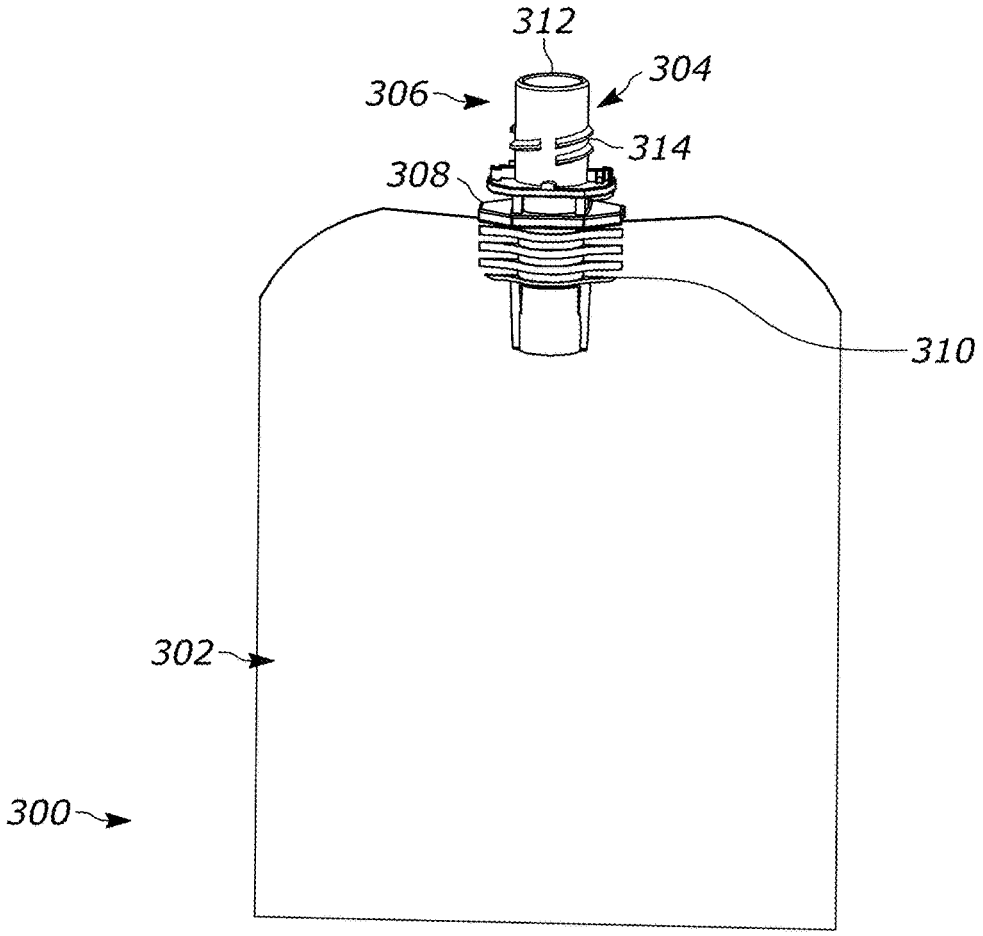
FIG. 19 of the drawings is a perspective view of a configuration of a pouch assembly suitable for filling by the filler assembly of the present disclosure, shown herein without a cap.
Figure 20:
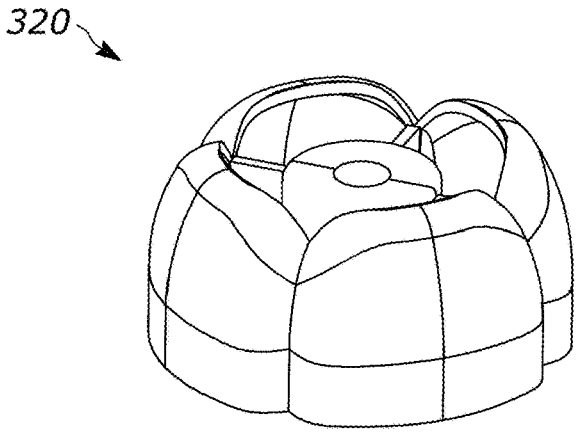
FIG. 20 of the drawings is a perspective view of a configuration of a cap suitable for capping the pouch assembly of FIG. 19.

The pouch assembly 300 is shown in FIGS. 19 and 20 as comprising pouch 302, spout 304 and cap 320. The spout 304 is coupled to the pouch 302 and includes upper portion 306, lower portion 310, and guide channel 308 therebetween. The lower portion 310 is coupled to the pouch in a fluid tight engagement. The cap 320 is configured to threadedly engage the upper portion about corresponding threads. The guide channel is configured to mate with the lower channel 204 of the pouch movement mechanism 23 so as to facilitate the movement of the pouch assembly through the filler assembly.

The filler assembly 10 is shown as comprising frame 12 defining an infeed where empty pouches are first introduced into the filler assembly, and outlet, wherein filled pouches exit the filler assembly. Extending from the frame are a number of different zones, including, pouch infeed zone 20, pouch preheat zone 22, pouch sterilization zone 24, pouch flush zone 26, pouch fill zone 28 and pouch cap zone 29. Pouch movement mechanism 23 directs the pouches through the different zones of the filler assembly sequentially.

Figure 15:
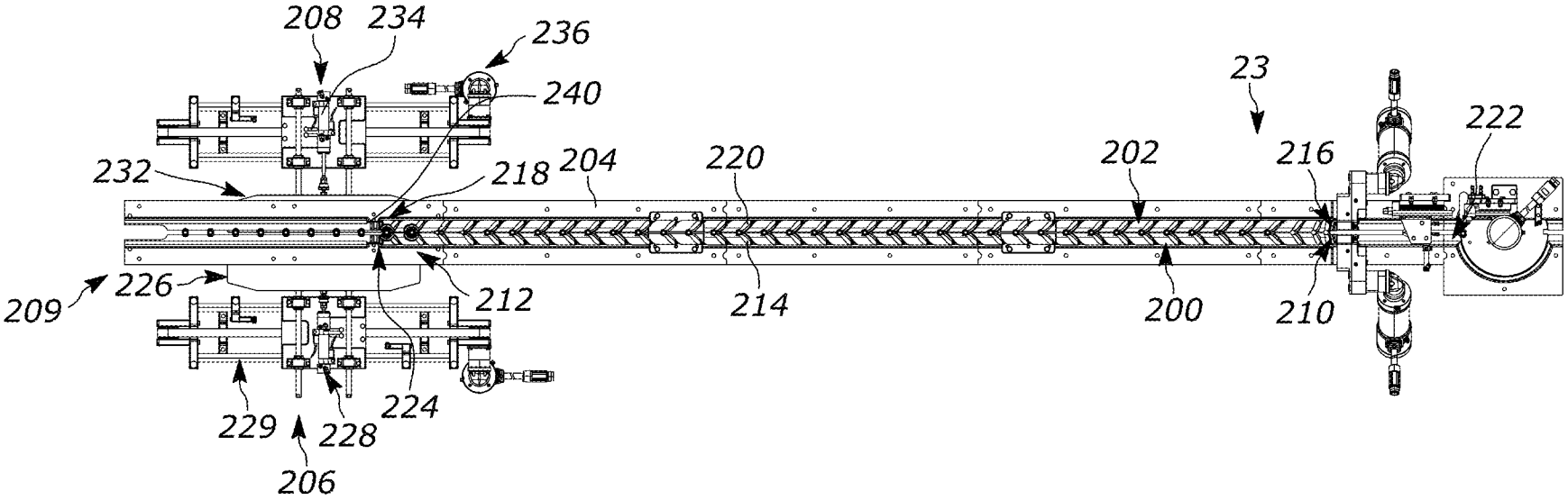
FIG. 15 of the drawings is top plan view of the pouch movement mechanism of the filler assembly of the present disclosure.
Figure 16:
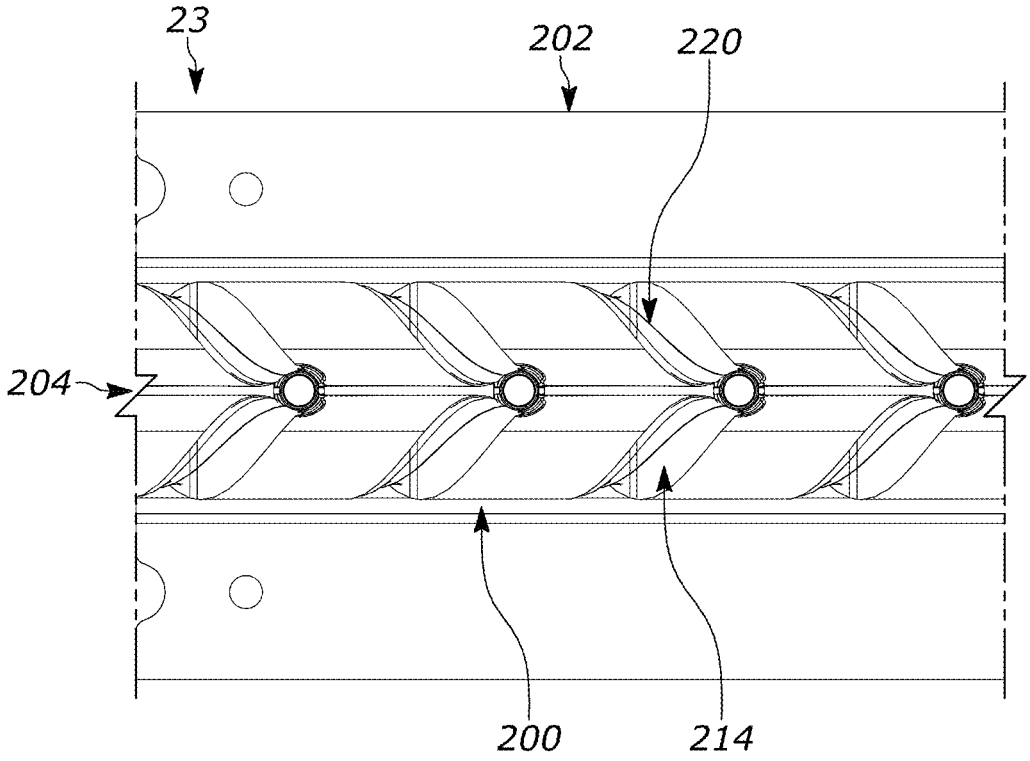
FIG. 16 of the drawings is a partial top plan view of the pouch movement mechanism, showing a portion of the region including the helical screws and the lower channel, with spouts positioned in the channel and corresponding to the helical slots of the helical screws.

With additional reference to FIG. 15, the pouch infeed zone 20 is configured to sequentially direct pouches into the first and second helical screws 200, 202 of the pouch movement mechanism 23. The pouch infeed zone may obtain pouches from a pouch holding rail full of pouches. Such rails can be sequentially releasably attached to the pouch infeed zone 20 for sequential feeding to the pouch movement mechanism 23.

Figure 5:
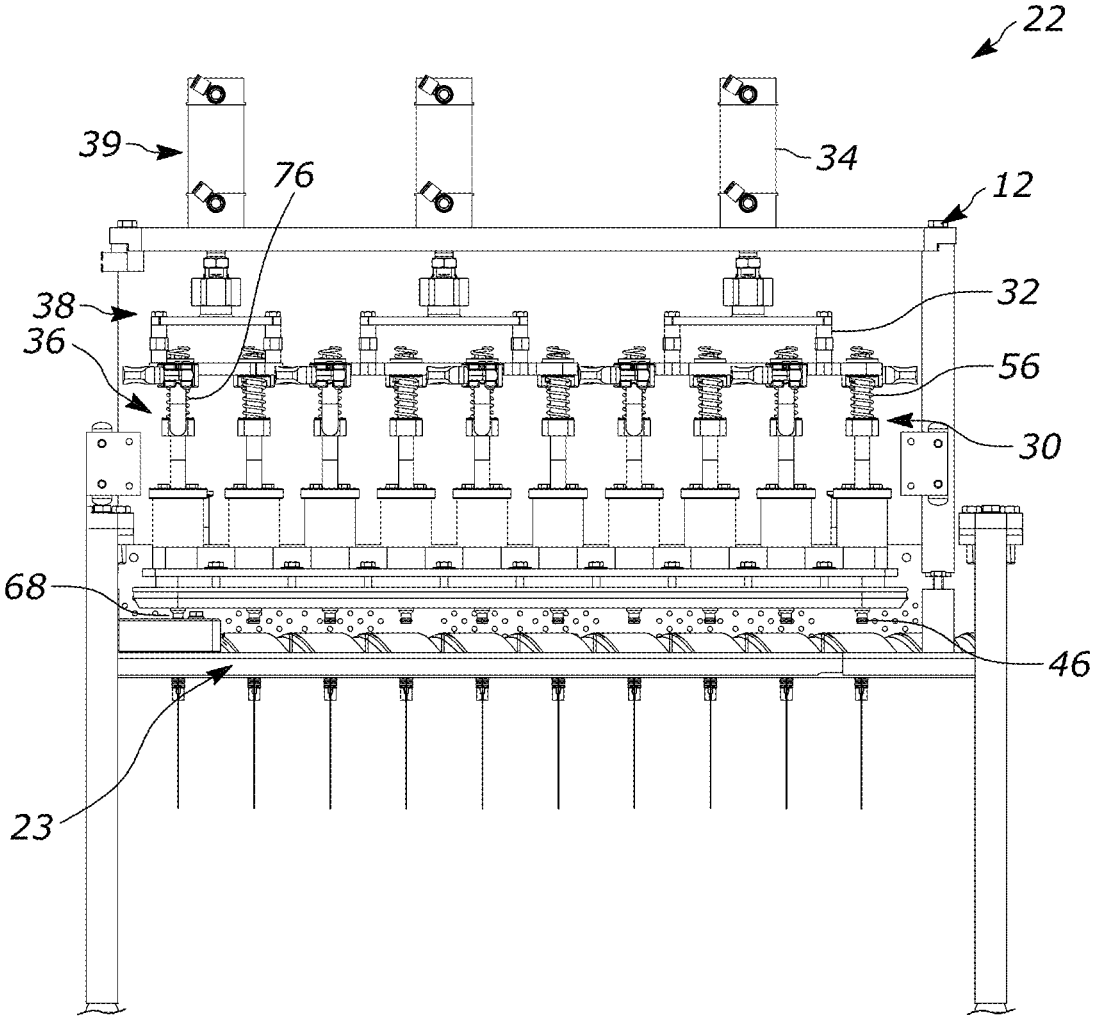
FIG. 5 of the drawings is a side elevational view of the pouch preheat zone, along with a portion of the pouch movement mechanism, and a plurality of pouch assemblies.
Figure 6:
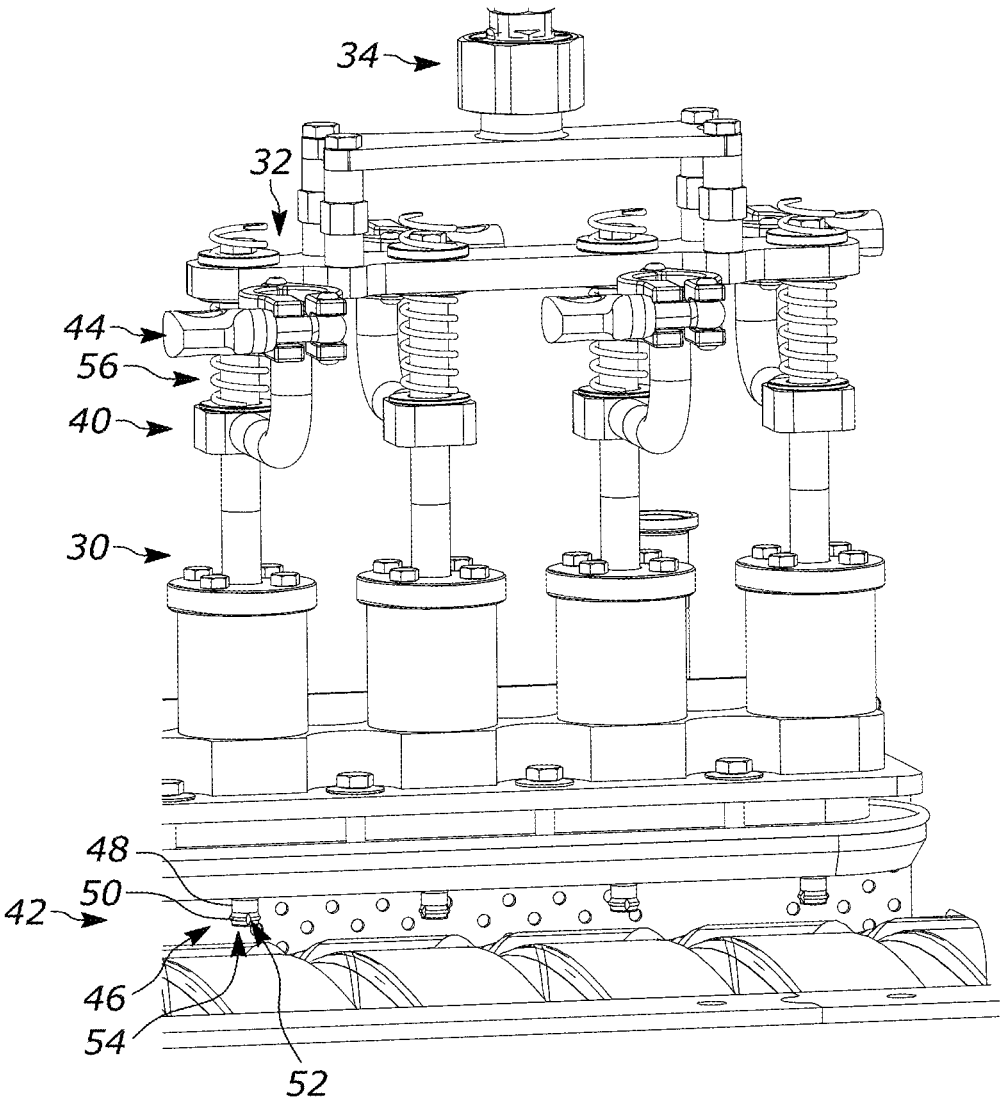
FIG. 6 of the drawings is a perspective view of a portion of the pouch preheat zone, showing a plurality of preheat nozzle assemblies.
Figure 7:
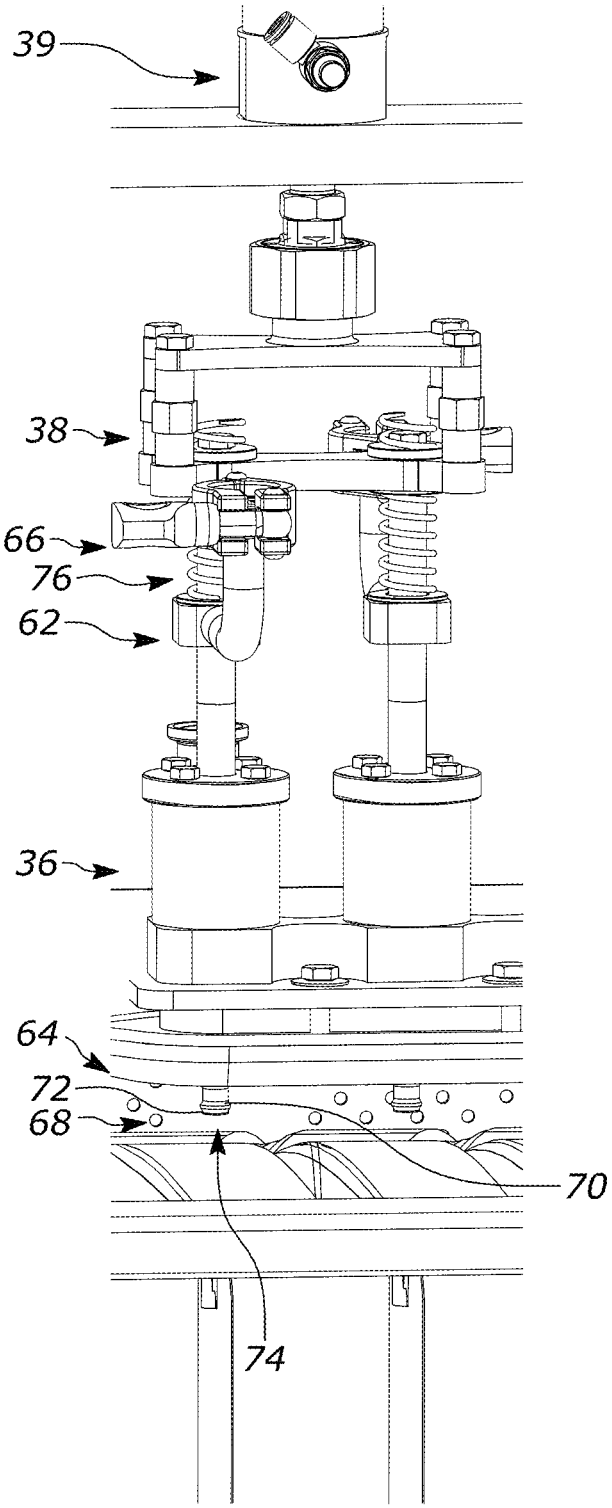
FIG. 7 of the drawings is a perspective view of a portion of the pouch preheat zone, showing a plurality of the preheat vacuum nozzle assemblies.

Referring now to FIGS. 5 through 7, the pouch preheat zone 22 comprise a plurality of preheat nozzle assemblies, such as preheat nozzle assembly 30, preheat nozzle mounting frame 32, preheat actuator 34, a plurality of preheat vacuum nozzle assemblies, such a preheat vacuum nozzle assembly 36, preheat vacuum nozzle frame 38 and preheat vacuum actuator 39. In the configuration shown, there are a total of eight preheat nozzle assemblies 30, in two groups of four, and two preheat vacuum nozzle assemblies 36 in a single group.

Each preheat nozzle assembly includes a first end 40 and a second end 42. A nozzle inlet 44 is positioned proximate the first end 40. Proximate the second end is the spout engagement portion 46. The spout engagement portion 46 includes outer surface 48, circumferential sealing rim 50, and transverse slots 52. The spout engagement portion 46 terminates at outlet 54. The spout engagement portion 46 is sized so that the circumferential sealing rim 50 generally corresponds to and sealingly interfaces with the inner surface of the spout 304 of the pouch assemblies. As will be explained herein, the transverse slots 52 provide a pathway for fluid to escape from within the pouch assembly. By allowing the fluid to escape from the pouch assembly, the fluid turnover within the pouch assembly is increased which increases the efficacy of the fluid and its operation within the pouch assembly (this efficacy increase assists with the preheat fluid, and, with respect to the other zones below, the sterilization fluid and the flush fluid). While four transverse slots are shown, a greater or fewer number of slots (all of which can have the same or different dimensions) can be disposed across the circumferential sealing rim. It will be understood that each of the eight preheat nozzle assemblies are substantially identical and are positioned sequentially within the pouch preheat zone at predetermined intervals.

In the configuration shown, the preheat nozzle mounting frame 32 is coupled to four preheat nozzle assemblies, with a biasing member 56 biasing the preheat nozzle assemblies away from the mounting frame. In the configuration shown, there are two preheat nozzle mounting frames, each coupled to four preheat nozzle assemblies.

A preheat actuator 34 is coupled to the frame at one end and to the preheat nozzle mounting frame 32 at the other end. It will be understood that two preheat actuators are provided, one for each of the preheat nozzle mounting frames 32. The preheat actuators 34 are configured to direct the preheat nozzle mounting frame between an upper position and a spout engaged position In the upper position, the spout engagement portion 46 of the preheat nozzle assemblies is spaced apart from the pouch assemblies. In the spout engaged position, the spout engagement portion 46 is positioned into engagement with the spout assembly.

Each preheat vacuum nozzle assembly 36 is shown as comprising first end 62, second end 64. A nozzle outlet 66 is positioned proximate the first end 40. Proximate the second end is the spout engagement portion 68. The spout engagement portion 68 includes outer surfaced 70 and circumferential sealing rim 72. The spout engagement portion 68 terminates at inlet 74. It will be understood that in the configuration shown, two preheat vacuum nozzle assemblies are shown, and the preheat vacuum nozzle assemblies are similar to the preheat nozzle assemblies 30, wherein the transverse slots are omitted from the preheat vacuum nozzle assemblies.

In the configuration shown, the preheat vacuum nozzle frame 38 is attached to both of the preheat vacuum nozzle assemblies 36 with a biasing member biasing the preheat vacuum nozzle assemblies away from the preheat vacuum nozzle frame 38. The preheat vacuum actuator 39 has a first end coupled to the frame, and a second end that is coupled to the preheat vacuum nozzle frame 38. As with the preheat actuator 34, the preheat vacuum actuator 39 likewise includes two positions, an upper position spaced apart from the spout of a pouch assembly, and a spout engaged position wherein the spout engagement portion of the preheat vacuum nozzle assembly engages the spout assembly.

It will be understood that variations are contemplated wherein a greater or a fewer number of preheat nozzle assemblies and preheat vacuum nozzle assemblies may be provided. In the configuration shown, and as will be described hereinbelow, the filler assembly is configured to index two pouches at once. As such, a first pouch of a pair will contact every other preheat nozzle assembly starting with the first one, and a second pouch of the pair will contact every other preheat nozzle assembly starting with the second one. As such, there are four separate contacts with a preheat nozzle assembly for each of the pouches, thereby defining four preheat nozzle treatments. Additionally, in the configuration shown, there are a pair of preheat vacuum nozzle assemblies. As such, the pair of pouches undergo a single preheat vacuum nozzle treatment.

It is further contemplated that each preheat nozzle assembly and each preheat vacuum nozzle assembly may be actuated by its own actuator. In other configurations, it is contemplated that pairs of preheat nozzle assemblies are actuated by a single actuator, or that all eight preheat nozzle assemblies are actuated by a single actuator.

It will be further understood that the nozzle inlet 44 of each of the preheat nozzle assemblies may be coupled to a source of heated sterilized air which is heated to a desired temperature, for example, between 12° and 220° C., while other temperatures are contemplated. It will likewise be understood that each of the nozzle outlet 66 of the preheat vacuum nozzle assemblies 36 are coupled to vacuum suction, wherein a vacuum can be pulled therethrough.

Figure 8:
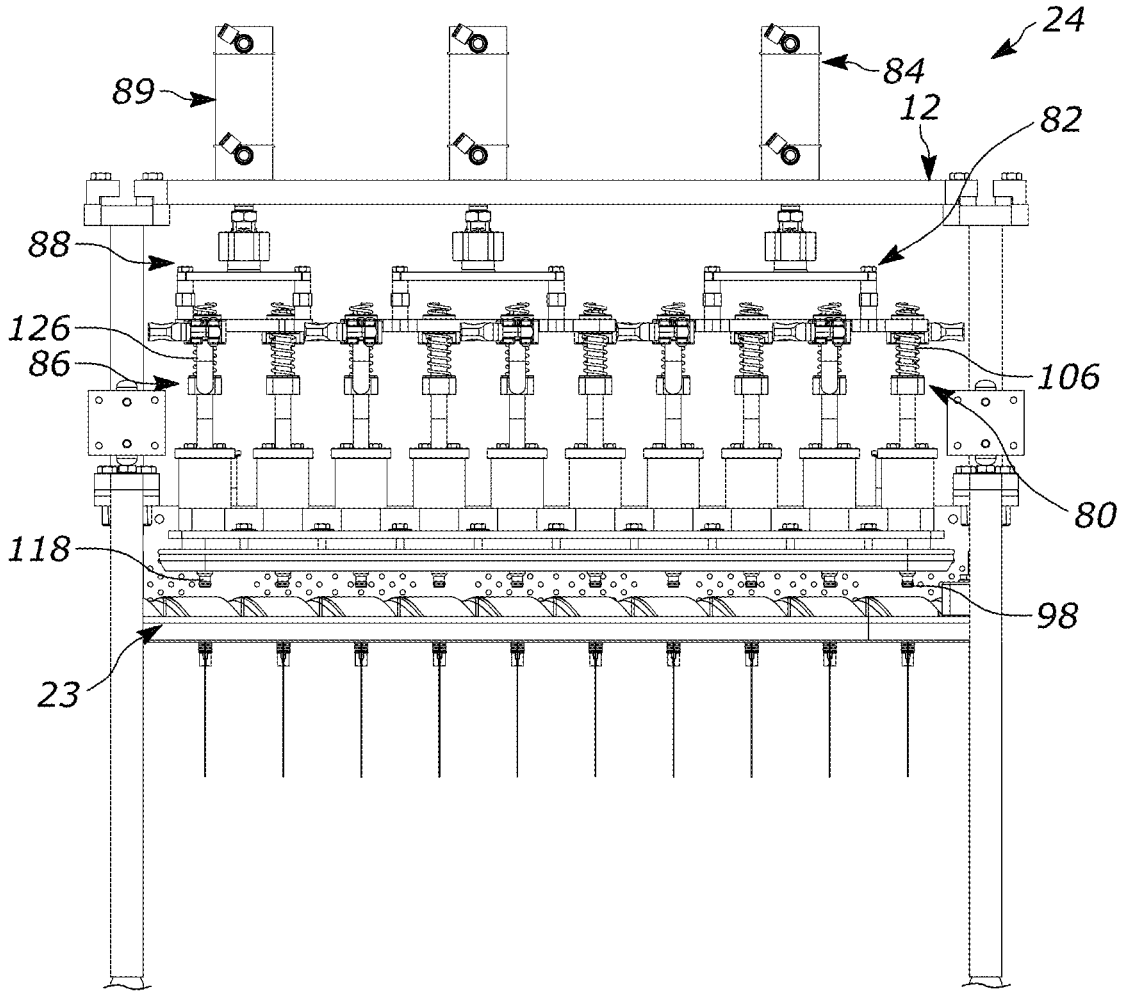
FIG. 8 of the drawings is a side elevational view of the pouch sterilization zone, along with a portion of the pouch movement mechanism, and a plurality of pouch assemblies.
Figure 9:
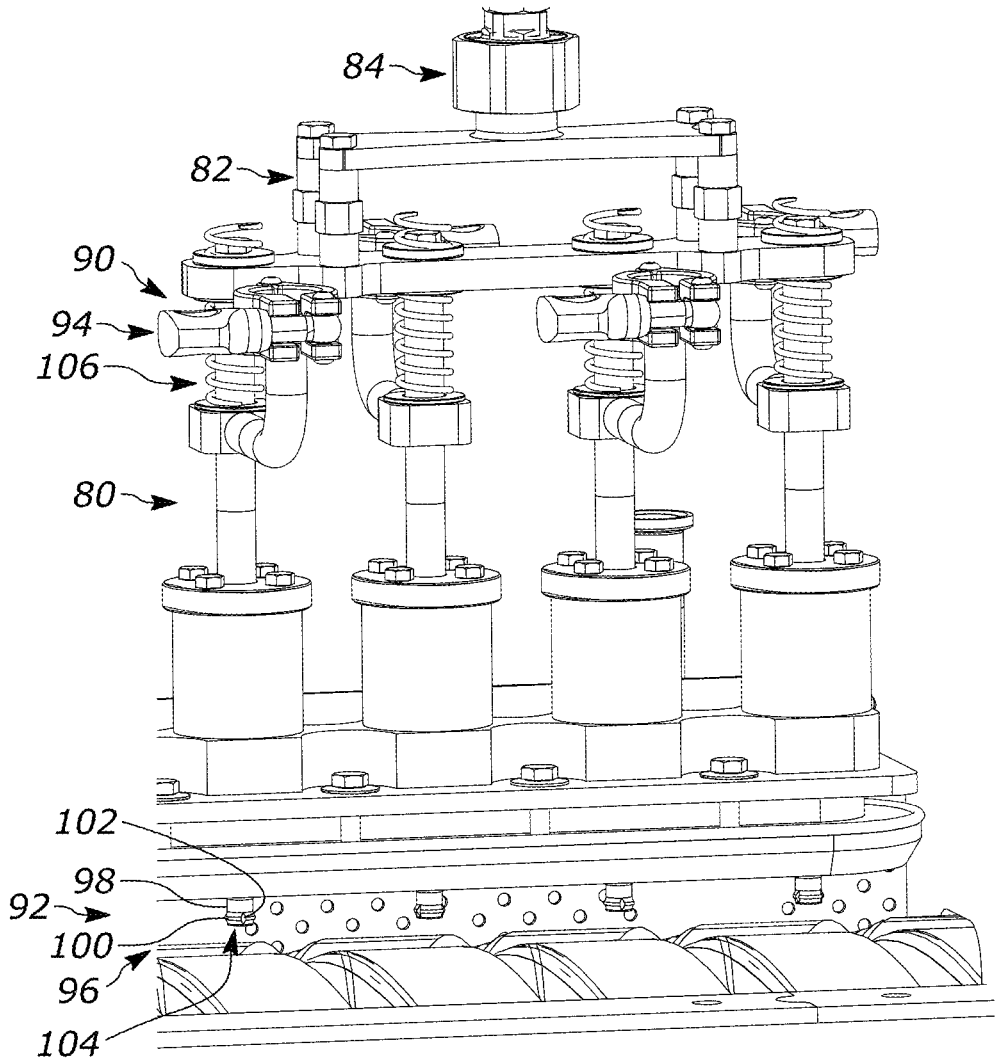
FIG. 9 of the drawings is a perspective view of a portion of the pouch sterilization zone, showing a plurality of sterilization nozzle assemblies.
Figure 10:
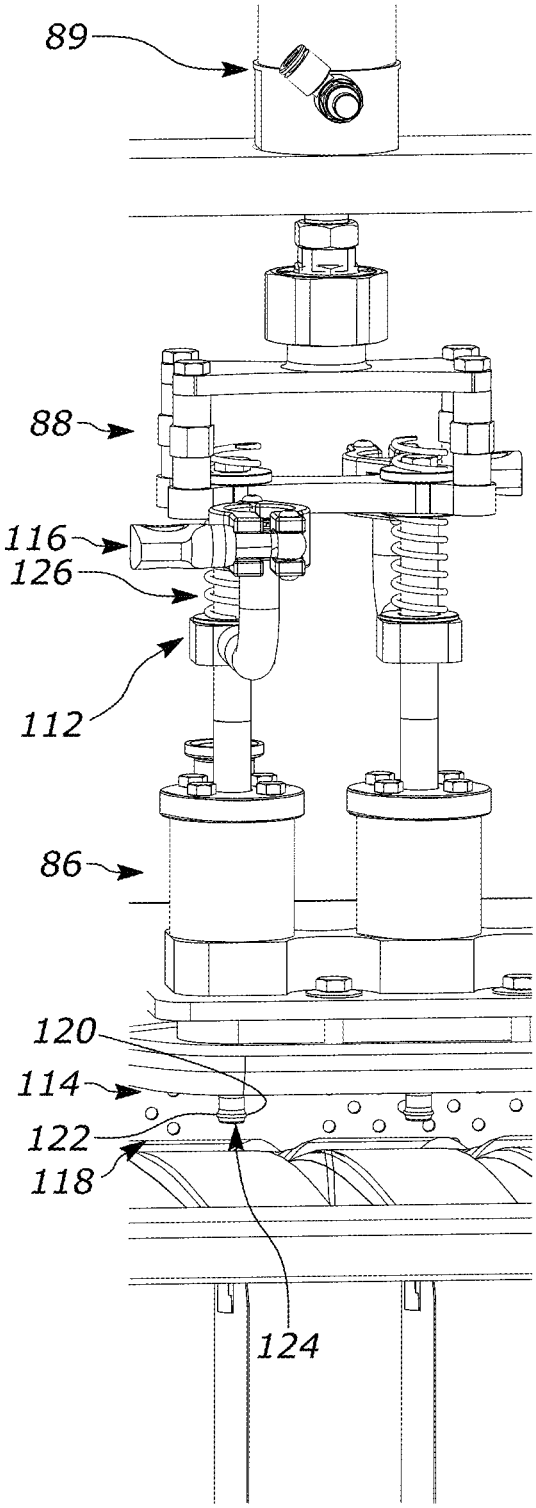
FIG. 10 of the drawings is a perspective view of a portion of the pouch sterilization zone, showing a plurality of the sterilization vacuum nozzle assemblies.

Referring now to FIGS. 8 through 10, pouch sterilization zone 24 is positioned sequentially within filler assembly 10 after the pouch preheat zone 22. The pouch sterilization zone 24 comprises a plurality of sterilization nozzle assemblies, such as sterilization nozzle assembly 80, sterilization nozzle mounting frame 82, sterilization actuator 84, sterilization vacuum nozzle assemblies, such as sterilization vacuum nozzle assembly 86, sterilization vacuum nozzle frame 88 and sterilization vacuum actuator 89. In the configuration shown, there are a total of eight sterilization nozzle assemblies 80, in two groups of four, and two sterilization vacuum nozzle assemblies 86 in a single group.

The foregoing components of the pouch sterilization zone 24 substantially match the configuration of the pouch preheat zone 22, while the operation and purpose of the pouch sterilization zone 24 is distinct from that of the pouch preheat zone 22.

Each sterilization nozzle assembly includes a first end 90 and a second end 92. A nozzle inlet 94 is positioned proximate the first end 90. Proximate the second end 92 is the spout engagement portion 96. The spout engagement portion 96 includes outer surface 98 circumferential sealing rim 100, and transverse slots 102. The spout engagement portion 96 terminates at outlet 104. The spout engagement portion 96 is sized so that the circumferential sealing rim 100 generally corresponds to and sealingly interfaces with the inner surface of the spout 304 of the pouch assemblies. As will be explained herein, the transverse slots 102 provide a pathway for fluid to escape from within the pouch assembly. It will be understood that each of the eight sterilization nozzle assemblies are substantially identical and are positioned sequentially within the pouch sterilization zone at predetermined intervals.

In the configuration shown, the sterilization nozzle mounting frame 82 is coupled to four sterilization nozzle assemblies, with a biasing member 106 biasing the sterilization nozzle assemblies away from the mounting frame. In the configuration shown, there are two sterilization nozzle mounting frames, each coupled to four sterilization nozzle assemblies.

A sterilization actuator 84 is coupled to the frame at one end and to the sterilization nozzle mounting frame 82 at the other end. It will be understood that two sterilization actuators are provided, one for each of the sterilization nozzle mounting frames 82. The sterilization actuators 84 are configured to direct the sterilization nozzle mounting frame between an upper position and a spout engaged position. In the upper position, the spout engagement portion 96 of the sterilization nozzle assemblies is spaced apart from the pouch assemblies. In the spout engaged position, the spout engagement portion 96 is positioned into engagement with the spout assembly.

Each sterilization vacuum nozzle assembly 86 is shown as comprising first end 112, second end 114. A nozzle outlet 116 is positioned proximate the first end 112. Proximate the second end is the spout engagement portion 118. The spout engagement portion 118 includes outer surfaced 120 and circumferential sealing rim 122. The spout engagement portion 118 terminates at inlet 124. It will be understood that in the configuration shown, two sterilization vacuum nozzle assemblies are shown, and the sterilization vacuum nozzle assemblies are similar to the sterilization nozzle assemblies 80, wherein the transverse slots are omitted from the sterilization vacuum nozzle assemblies.

In the configuration shown, the sterilization vacuum nozzle frame 88 is attached to both of the sterilization vacuum nozzle assemblies 86 with a biasing member biasing the sterilization vacuum nozzle assemblies away from the sterilization vacuum nozzle frame 88. The sterilization vacuum actuator 89 has a first end coupled to the frame, and a second end that is coupled to the sterilization vacuum nozzle frame 88. As with the sterilization actuator 84, the sterilization vacuum actuator 89 likewise includes two positions, an upper position spaced apart from the spout of a pouch assembly, and a spout engaged position wherein the spout engagement portion of the sterilization vacuum nozzle assembly engages the spout assembly.

Similar to the preheat zone, in the configuration shown, the first pouch of a pair of pouches will contact every other sterilization nozzle assembly starting with the first one, and a second pouch of the pair of pouches will contact every other sterilization nozzle assembly starting with the second one. As such, there are four separate contacts with a sterilization nozzle for each of the pouches, thereby defining four sterilization nozzle treatments. Additionally, in the configuration shown, there are a pair of sterilization vacuum nozzle assemblies. As such, the pair of pouches undergo a single sterilization vacuum nozzle treatment.

As with the preheat zone, each of the sterilization nozzle assemblies and each of the sterilization vacuum nozzle assemblies may be actuated by a single actuator, or any combination of coupling of the nozzle assemblies may be undertaken so as to have a single actuator actuate multiple nozzle assemblies.

In the configuration shown, each of the nozzle inlets 94 of each of the sterilization nozzle assemblies may be coupled to a source of hydrogen peroxide vapor. Without being limiting, and solely for purposes of illustration, the hydrogen peroxide concentration is in excess of 30%, with the vaporization temperature being greater than 235° F. and a hydrogen peroxide dose being greater than 5 g/min. Of course, other concentrations, temperatures and flow rates are contemplated. It will also be understood that the nozzle outlet 126 of the sterilization vacuum nozzle assemblies 86 are coupled to vacuum suction, wherein a vacuum can be pulled therethrough.

Figure 11:
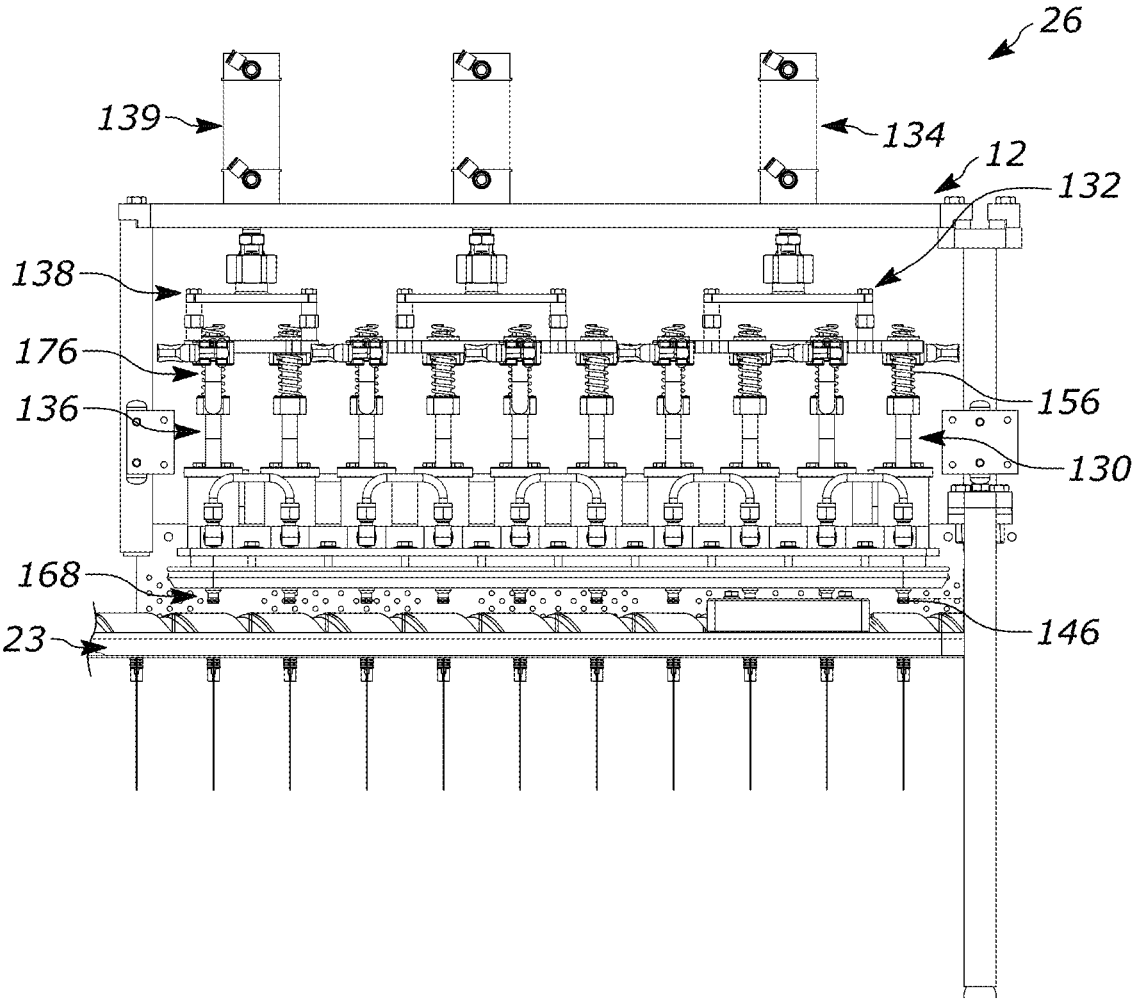
FIG. 11 of the drawings is a side elevational view of the pouch flush zone, along with a portion of the pouch movement mechanism, and a plurality of pouch assemblies.
Figure 12:
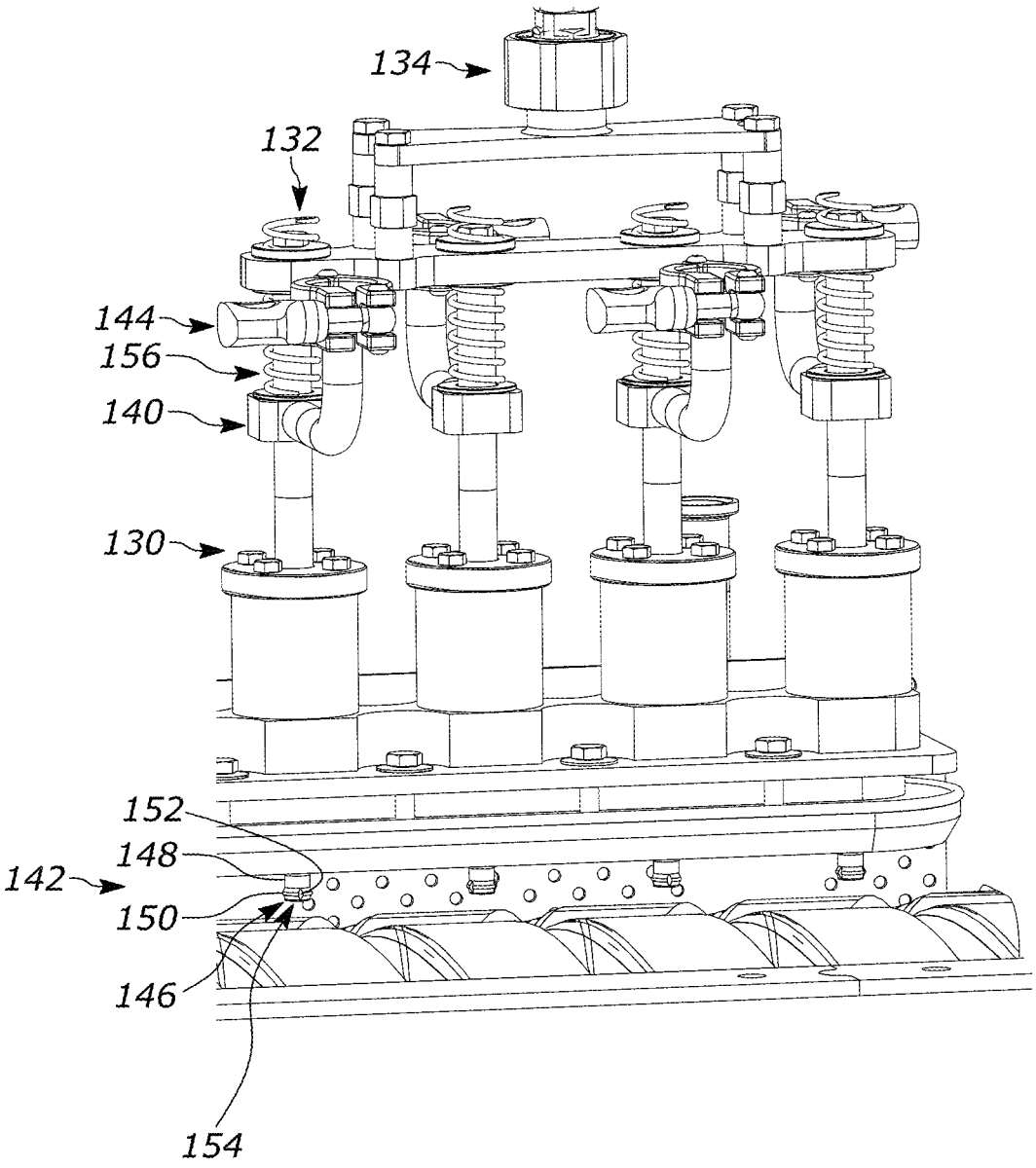
FIG. 12 of the drawings is a perspective view of a portion of the pouch flush zone, showing a plurality of flush nozzle assemblies.
Figure 13:
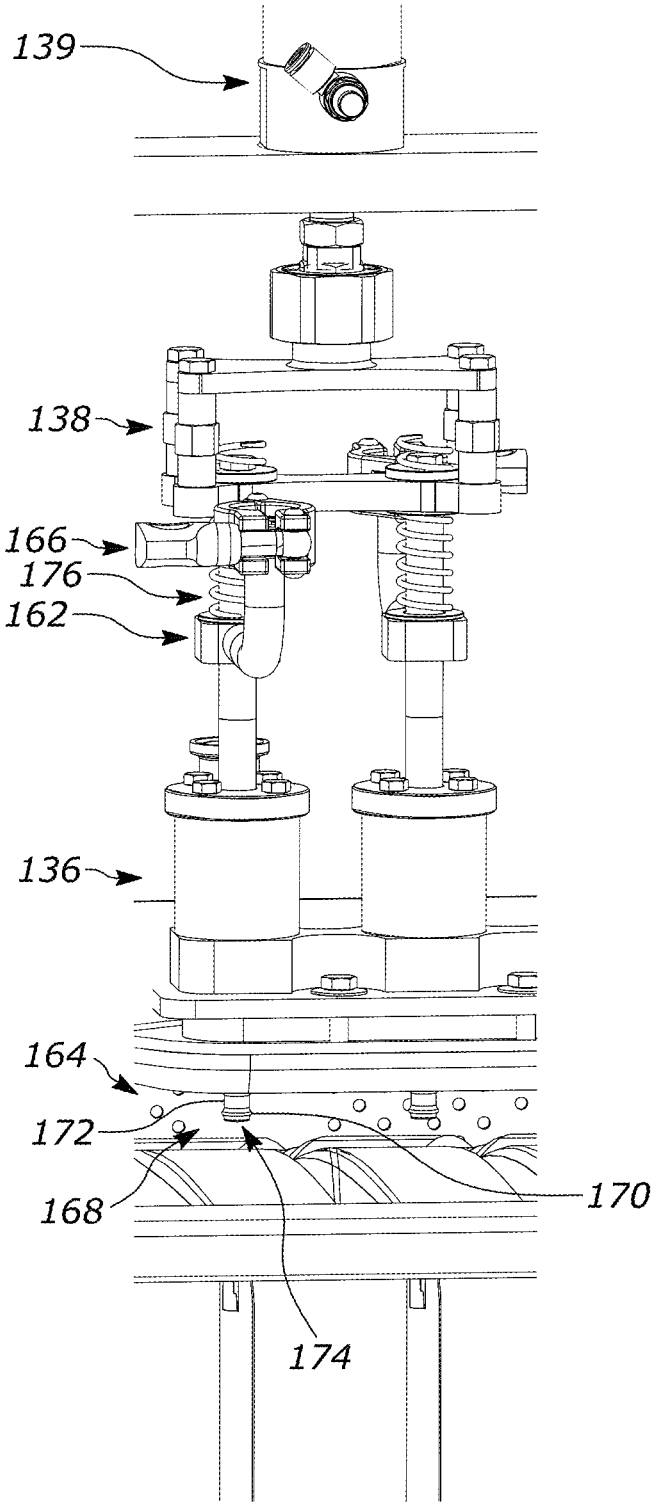
FIG. 13 of the drawings is a perspective view of a portion of the pouch flush zone, showing a plurality of the flush vacuum nozzle assemblies.

With reference to FIGS. 11 through 13, the pouch flush zone 26 is positioned sequentially within filler assembly 10 after the pouch sterilization zone 24. The pouch flush zone comprises a plurality of flush nozzle assemblies 130, flush nozzle mounting frame 132, flush actuator 134, flush vacuum nozzle assemblies, such as flush vacuum nozzle assembly 136, flush vacuum nozzle frame 138 and flush vacuum actuator 139. In the configuration shown, there are a total of eight flush nozzle assemblies 130 positioned in two groups of four, and two flush vacuum nozzle assemblies 136 in a single group.

The foregoing components of the pouch flush zone 26 substantially match the configuration of the pouch sterilization zone 24 and the pouch preheat zone 22, while the operation and purpose of the pouch flush zone 26 is distinct from that of the pouch sterilization zone 24 and the pouch preheat zone 22.

Each flush nozzle assembly includes a first end 140 and a second end 142. A nozzle inlet 144 is positioned proximate the first end 140. Proximate the second end 142 is the spout engagement portion 146. The spout engagement portion 146 includes outer surface 149, circumferential sealing rim 150, and transverse slots 152. The spout engagement portion 146 terminates at outlet 154. The spout engagement portion 146 is sized so that the circumferential sealing rim 150 generally corresponds to and sealingly interfaces with the inner surface of the spout 304 of the pouch assemblies. As will be explained herein, the transverse slots 152 provide a pathway for fluid to escape from within the pouch assembly. It will be understood that each of the eight flush nozzle assemblies are substantially identical and are positioned sequentially within the pouch flush zone at predetermined intervals.

In the configuration shown, the flush nozzle mounting frame 132 is coupled to four preheat nozzle assemblies, with a biasing member 156 biasing the flush nozzle assemblies away from the mounting frame. In the configuration shown, there are two flush nozzle mounting frames, each coupled to four flush nozzle assemblies.

A flush actuator 134 is coupled to the frame at one end and to the flush nozzle mounting frame 132 at the other end. It will be understood that two flush actuators are provided, one for each of the flush nozzle mounting frames 132. The flush actuators 134 are configured to direct the flush nozzle mounting frame between an upper position and a spout engaged position. In the upper position, the spout engagement portion 146 of the flush nozzle assemblies is spaced apart from the pouch assemblies. In the spout engaged position, the spout engagement portion 146 is positioned into engagement with the spout assembly.

Each flush vacuum nozzle assembly 136 is shown as comprising first end 162, second end 164. A nozzle outlet 166 is positioned proximate the first end 162 Proximate the second end is the spout engagement portion 168. The spout engagement portion 168 includes outer surface 172 and circumferential sealing rim 170. The spout engagement portion 164 terminates at inlet 174. It will be understood that in the configuration shown, two flush vacuum nozzle assemblies are shown, and the flush vacuum nozzle assemblies are similar to the flush nozzle assemblies 130, wherein the transverse slots are omitted from the flush vacuum nozzle assemblies.

In the configuration shown, the flush vacuum nozzle frame 138 is attached to both of the flush vacuum nozzle assemblies 136 with a biasing member biasing the flush vacuum nozzle assemblies away from the flush vacuum nozzle frame 138. The flush vacuum actuator 139 has a first end coupled to the frame, and a second end that is coupled to the flush vacuum nozzle frame 138. As with the flush actuator 134, the flush vacuum actuator 139 likewise includes two positions, an upper position spaced apart from the spout of a pouch assembly, and a spout engaged position wherein the spout engagement portion of the flush vacuum nozzle assembly engages the spout assembly.

Similar to the preheat zone and the sterilization zone, in the configuration shown, the first pouch of a pair of pouches will contact every other flush nozzle assembly starting with the first one, and a second pouch of the pair of pouches will contact every other flush nozzle assembly starting with the second one. As such, there are four separate contacts with a flush nozzle for each of the pouches, thereby defining four flush nozzle treatments. Additionally, in the configuration shown, there are a pair of flush vacuum nozzle assemblies. As such, the pair of pouches undergo a single flush vacuum nozzle treatment.

As with the preheat zone, each of the flush nozzle assemblies and each of the flush vacuum nozzle assemblies may be actuated by a single actuator, or any combination of coupling of the nozzle assemblies may be undertaken so as to have a single actuator actuate multiple nozzle assemblies.

In the configuration shown, each of the nozzle inlets 144 of each of the flush nozzle assemblies may be coupled to a source of sterile air, which may be at a temperature of between 12° and 220° C. It will also be understood that the nozzle outlet 166 of the flush vacuum nozzle assemblies 136 are coupled to vacuum suction, wherein a vacuum can be pulled therethrough.

Figure 14:
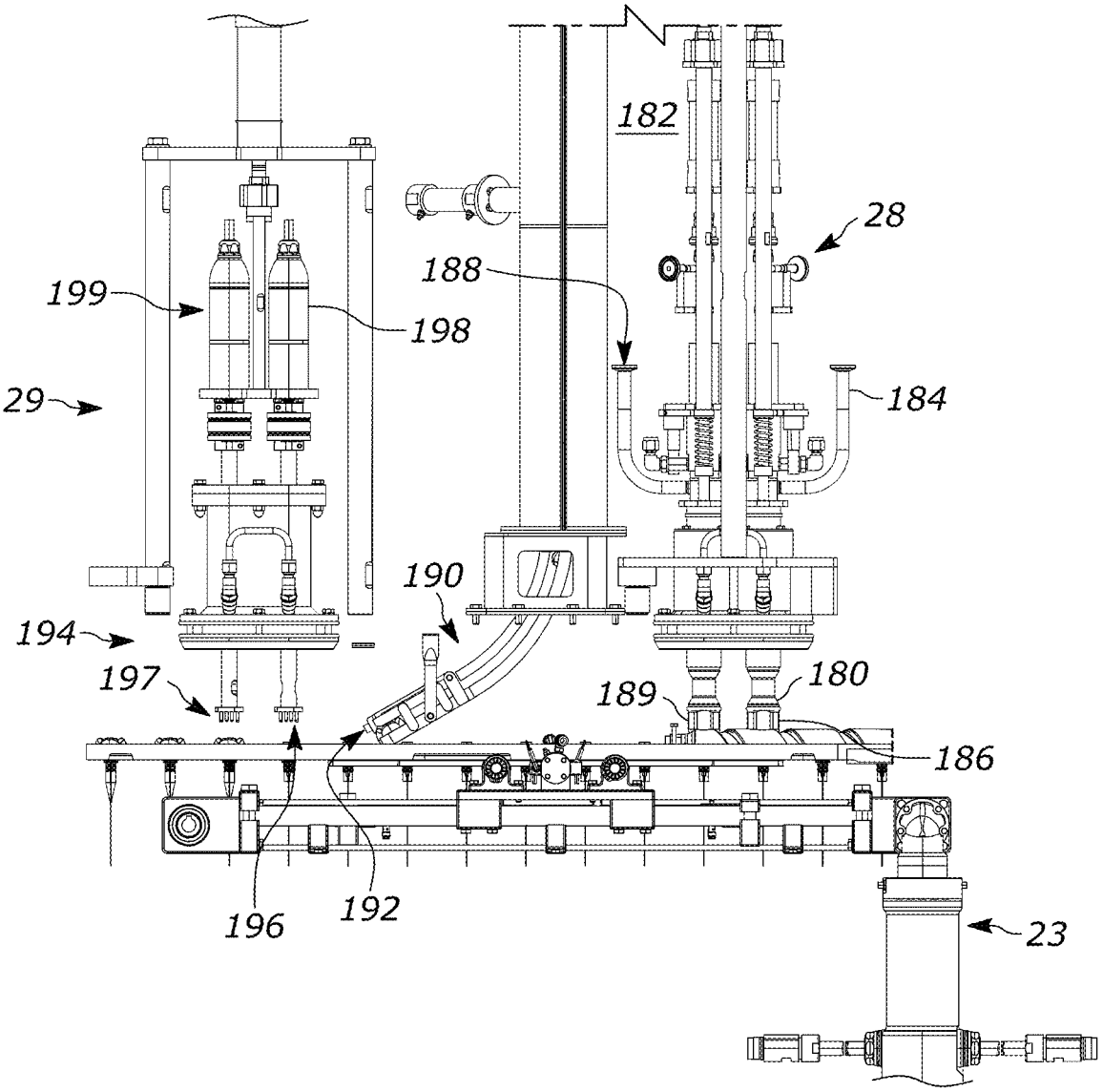
FIG. 14 of the drawings is a side elevational view of the pouch fill zone and the pouch cap zone, showing a portion of the pouch movement mechanism, and a plurality of pouch assemblies.

With reference to FIG. 14, the pouch fill zone 28 in the configuration shown comprises a first fill valve 180 and a second fill valve 182. First fill valve includes an inlet 184 and an outlet 186. The second fill valve includes inlet 188 and outlet 189. In the configuration shown, the two fill valves can be actuated simultaneously to fill two pouches at the same time. In the configuration shown, the fill valves may further include a vacuum outlet, so that prior to fill, a final vacuum can be pulled on the pouch assembly. Furthermore, the fill valves may have a nitrogen gas source so that upon filling, nitrogen gas can be used to displace any sterile air that may remain in the container, as nitrogen gas has superior performance relative to degradation of the flowable material with which the pouch assembly is filled.

With continued reference to FIG. 14, the pouch cap zone 29 in the configuration shown comprises cap feed channel 190 and cap twisting assembly 194. The cap feed channel 190 comprises a gravity fed channel that is configured to correspond to the shape of the caps, so as to direct the caps to the lower end 192. As will be explained, when the cap reaches the lower end, the cap is positioned so that the spout engages the cap and directs the cap onto the spout and out of the cap feed channel.

The cap twisting assembly 194 comprises a pair of cap engaging bits 196, 197, each of which are rotatably mounted to rotational actuator 198, 199, respectively. The cap engaging bits comprise a plurality of protrusions which mate with the recesses in the cap, whereupon rotation of the cap engaging bits, the respective cap rotates in unison therewith. Of course, the shape of the cap engaging bits may change, depending on the configuration of the cap, with the understanding the that the cap engaging bit is configured to releasably engage the cap and to rotationally releasably couple with the cap.

Referring now to FIGS. 15 through 18, collectively with FIGS. 1 through 4, the pouch movement mechanism 23, as explained above, directs the pouch assemblies through the filler assembly, and in particular from the second end of the pouch infeed zone, through the pouch preheat zone, the pouch sterilization zone, the pouch flush zone, the pouch fill zone, and the pouch cap zone. In the configuration shown, the pouch movement mechanism 23 comprises two different regions, one of which directs the pouch assemblies from the second end of the pouch infeed zone through the pouch fill zone (i.e., until the pouch is filled), and the other of which directs the pouch assemblies from the pouch fill zone through the pouch cap zone (which includes the cape placement onto the spout and the cap securement to the spout.

More particularly, the first region comprises a pair of helical screws defining a first helical screw 200 and a second helical screw 202, and a lower channel 204. The first helical screw comprises a first end 210, second end 212 and helical slot 214. The second helical screw comprises first end 216, second end 218 and helical slot 220.

The first and second helical screws rotate about parallel axis of rotation that extend longitudinally through the filler assembly, and define the direction of travel of the pouch assemblies together with the lower channel. The lower channel is disposed about a longitudinal axis that is parallel to the axis of rotation of each of the first and second helical screws, and generally below and mid-way between the two axis of rotation. The channel is sized so as to receive, slidably, the pouch assembly, and more particularly, so that the guide channel 308 can engage span across the lower channel and be slidably movable therealong from the first end to the second end. In the configuration shown, the configuration of the guide channel of the pouch assembly relative to the lower channel is such that rotation of the pouch assembly relative to the channel is precluded.

The helical windings are such that they correspond to each other such that the helical slots line up with each other as the helical screws rotate. Portions of the helical slots can be enlarged so as to facilitate the passage of one of the nozzles of any one of the zones to engage the respective spout of the pouch assemblies, being obstructed by or interfering with the helical screws.

The upper portion 306 of the spout of the pouch assemblies engages with the helical slots 214, 220 so that rotation of the first and second helical screws in opposing directions controllably translates the pouch along the lower channel between the first and second ends of the channel. It will be understood that the first and second helical screws can be driven by electric motors which can be coupled to the helical screws through a gear train, or the like.

Proximate the second end of the first and second helical screws, the second region of the pouch movement mechanism is positioned. The second region includes first linear movement assembly 206 positioned on one side of the pouch assemblies, second linear movement assembly 208 and linear lower channel 209. The linear lower channel 209 generally comprises an extension of the lower channel 204 extending from the second end 224 of the lower channel 204, and generally includes similar dimensions as the lower channel 204.

The first linear movement assembly includes pouch engagement member 226, transverse actuator 228 and longitudinal movement member 229. The pouch engagement member 226 includes a generally planar member having an inner edge with a plurality of receiving slots 230 that are spaced a apart a distance relative to each other (preferably a distance generally corresponding to the distance between any two nozzles adjacent of the zones). In the configuration shown, a total of eight receiving slots, such as receiving slot 230 are disposed along the inner edge.

In general, the transverse actuator 228 is configured to direct the pouch engagement member 226 inwardly and outwardly, toward and away from the linear lower channel 209 on a first side thereof. The longitudinal movement member is configured to direct the pouch engagement member longitudinally (i.e., parallel to the linear lower channel 209) toward the first or second end of the linear lower channel). In the configuration shown, the transverse actuator comprises a pneumatic actuator. And, the longitudinal movement member comprises a linear actuator which includes a servo motor driving a cogged belt that is fixed in movement to the pouch engagement member 226. Thus, the pouch engagement member can move both toward and away from the linear lower channel as well as along a path that is substantially parallel to the linear lower channel, or a combination of both movements.

Similarly, the second linear movement assembly includes pouch engagement member 232, transverse actuator 234 and longitudinal movement member 236. The pouch engagement member 232 includes a generally planar member that has an inner edge with a plurality of receiving slots 238, which are configured (as with receiving slots 230) in a spaced apart configuration. As with the receiving slots 230, a total of eight receiving slots 238 are presented along the inner edge of the pouch engagement member.

Similarly, the transverse actuator 234 comprises a pneumatic actuator that directs the pouch engagement member toward and away from the linear lower channel 209. And, the longitudinal movement member 236 comprises a linear actuator which includes a servo motor driving a cogged belt that is fixed in movement to the pouch engagement member 232. Thus, the pouch engagement member can both move toward and away from the linear lower channel as well as travel along a path that is substantially parallel to the linear lower channel, or a combination of both movements.

The first linear movement assembly and the second linear movement assembly are independently movable relative to each other. That is, pouch engagement member 226 an the pouch engagement member 232 can move independently of each other and separately or collectively engage the respective pouch assemblies positioned along the linear lower channel.

The operation will be described with respect to the travel of a pouch assembly, or a series of pouch assemblies through the filler assembly from the pouch infeed zone to the pouch cap zone. It will be understood that while a single line (defined by the lower channel 204 and the linear lower channel 209, FIG. 15) is shown, it is contemplated that a filler assembly may have multiple lines that are positioned in a side by side orientation within the same frame. For example, two side by side lines may be configured within the same frame, while more than two are likewise contemplated. Additionally, it is contemplated that while the pouch assemblies travel through the filler assembly in pairs, other configurations (such as single pouches as well as multiples in excess of three pouches) are contemplated.

More specifically, and with reference to FIGS. 1 through 4, a plurality of pouch assemblies is first supplied to the pouch infeed zone 20. Such pouch assemblies may be positioned on a rail or the like, as will be known by one of skill in the art. Once provided, the pouch assemblies are sequentially directed to the pouch preheat zone 22. In greater detail, and with reference to FIGS. 15 through 18, each pouch is sequentially directed to the first end of the pouch movement mechanism and positioned at the first end of the lower channel 204. At the same time, the first and second helical screws are positioned so as to receive the spout within the respective helical slots 214, 220 thereof. As the helical screws rotate about their respective axis of rotation, the pouch assembly is urged along the lower channel by the interaction between helical slots and the spout of the pouch assembly. Similarly, one by one additional pouch assemblies are directed into the pouch preheat zone 22.

With reference to FIGS. 5 through 7, within the pouch preheat zone, the pouches advance in by pairs. Initially the first two pouch assemblies will encounter the first two preheat nozzle assemblies. Once the pouches are properly positioned, each of the preheat actuator 34 actuate to direct the preheat nozzle assemblies to the spout engaging position. In turn, the first two preheat nozzle assemblies engage the spouts of the first two pouch assemblies with the circumferential sealing rims engaging an inside surface in a substantially sealed engagement. Once engaged, heated air is directed through the outlet of the preheat nozzle assembly and into the pouch assemblies. The pouch assemblies expand as they are filled, and, eventually, excess preheated air is directed out of the pouch assemblies through the transverse slots in the spout engagement portion so as to traverse beyond the circumferential sealing rim and out of the pouch assemblies. This step continues for a predetermined period of time so as to increase the temperature of the pouch assembly.

The preheat actuator 34 then returns to the upper position, disengaging the preheat nozzle assemblies from the pouch assemblies. Once disengaged, the pouches move in pairs to the third and fourth preheat nozzle assemblies. The process is then repeated wherein heated air is directed into the pouch assemblies through the outlet of the respective preheat nozzle assemblies and excess air is ejected from the pouch assemblies through the transverse slots. After a predetermined period of time, the actuator returns the preheat nozzle assembly to the upper position, and, the two pouch assemblies are moved in pairs to the fifth and sixth preheat nozzle assemblies. The process is repeated and then the two pouch assemblies are moved in pairs to the seventh and eighth preheat nozzle assemblies, wherein the process is again repeated.

It will be understood that subsequent pouch assemblies are, at the same time, entering into the filler assembly sequentially and undergoing the same processes in the same sequence.

After the final ones of the preheat nozzle assemblies, the pair of pouch assemblies are moved in pairs to the preheat vacuum nozzle assemblies, wherein the preheat vacuum actuator 39 moves the preheat vacuum nozzle assemblies into the spout engaging position. At such time, a vacuum is pulled through the preheat vacuum nozzle assemblies and the air is evacuated from within the pouch assembly.

With additional reference to FIGS. 8 through 10, the generally collapsed pouch assemblies then move in pairs to the pouch sterilization zone, wherein a process much like that which is described above is undertaken sequentially through four pairs of sterilization nozzle assemblies 80. However, rather than supplying heated air, in the pouch sterilization zone, through each of the four successive interactions with the sterile nozzle assembly, the sterilization nozzle assemblies deliver a vaporized hydrogen peroxide, and excess hydrogen peroxide is directed out of the pouch assemblies through the transverse slots in the sterilization nozzle assemblies.

After the four sterilization treatments, the pouch assemblies move in pairs to the sterilization vacuum nozzle assembly, and when the sterilization vacuum actuator is positioned in the spout engaging position, a vacuum is pulled evacuating the vaporized hydrogen peroxide from within the pouch assemblies. The generally collapsed pouch assemblies are directed by the cooperative rotation of the helical screws to the pouch flush zone.

With additional reference to FIGS. 11 through 13, in the pouch flush zone, and in a similar manner as prior zones, the pouch assemblies move in pairs through the four pairs of flush nozzle assemblies. Each successive flush nozzle assembly flushes the respective one of the pouch assemblies with sterile air to flush residual vaporized hydrogen peroxide from within the pouch assemblies. Any excess sterile air is directed out of the pouch assemblies through the transverse slots of the flush nozzle assemblies. The pouch assemblies undergo the same process through each of the four pairs of flush nozzle assemblies. Finally, the pouch assemblies move in pairs to the flush vacuum nozzle assemblies wherein the flush vacuum nozzle actuator is directed into the spout engaging position wherein the flush vacuum nozzle assemblies engage the spouts of the spout assemblies. A vacuum is pulled through the flush vacuum nozzle assemblies, and sterile air that was directed into the pouch assemblies is removed through the pulled vacuum.

Once the flush air is removed and the pouch assemblies are in a generally collapsed configuration, the pouches are directed into the pouch fill zone. It will be understood that the vacuum steps between each of the preheat and sterilization zones, and the sterilization zone and the flush zone and between the flush zone and the fill zone minimize the mixing of the gasses from each one of the zones with a subsequent zone, and such fluids are removed to a greater degree through the vacuum. Additionally, at each zone, by removing fluid from a prior zone, the efficacy of the fluid utilized in the particular zone can be increased—that is, the fluid use is not compromised through contamination with a fluid of a previous zone.

With reference to FIG. 14, in the pouch fill zone 28, the first fill valve is coupled to the first of the two pouch assemblies, and the second fill valve is coupled to the second of the two pouch assemblies. A vacuum may be pulled first, to remove any residual sterilized air that may remain after the pouch flush zone, or which may have returned after the flush vacuum nozzle assemblies were disconnected from the pouch assemblies. Subsequently, flowable material may be directed through the fill valves and into the pouch assemblies. The fill can be controlled by flow rate and time, or by volume, or other manner to fill the pouch assemblies with the desired amount of flowable material. Once filled with flowable material, nitrogen gas can be directed into the pouch assemblies to displace any air that may remain in the headspace.

Figure 17:
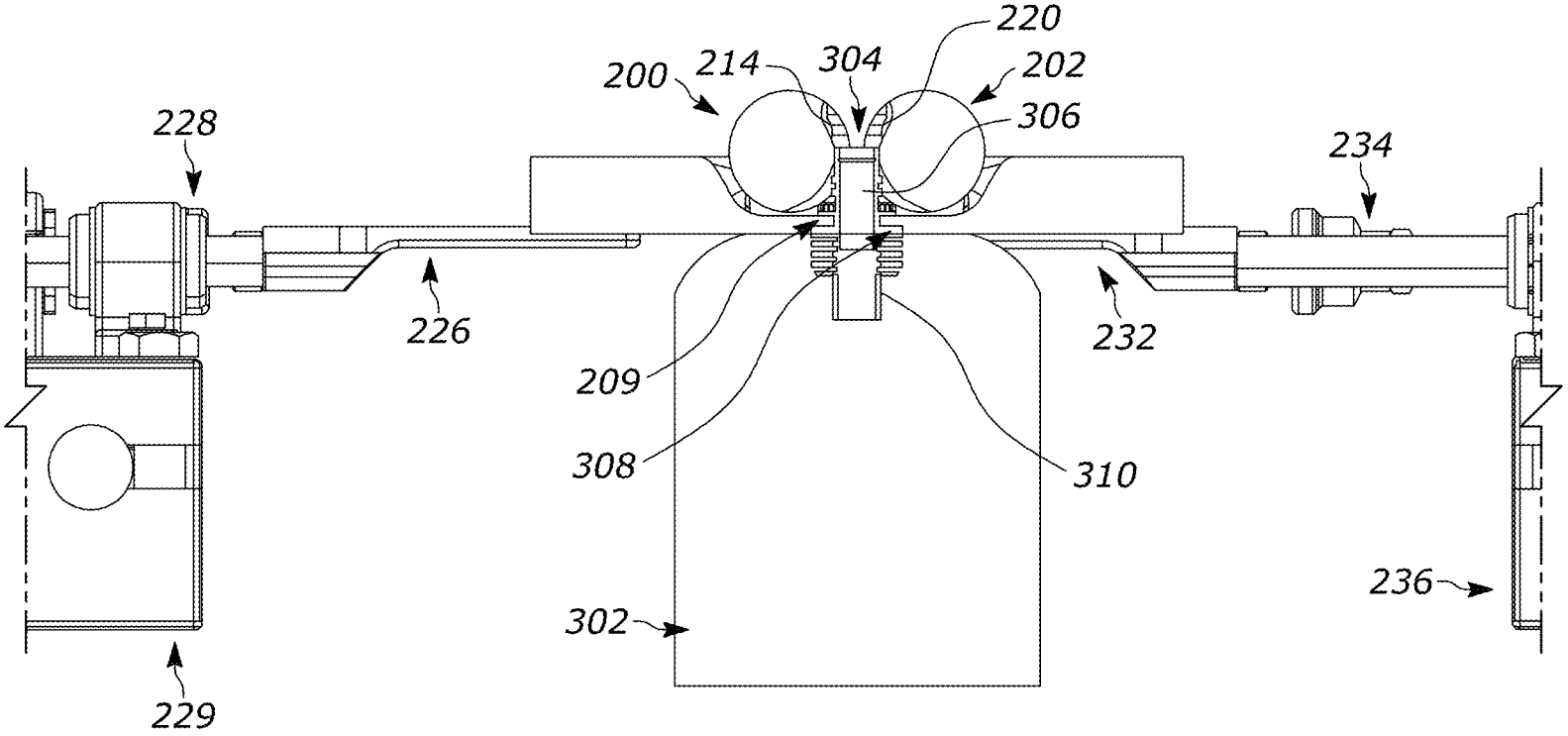
FIG. 17 of the drawings is a cross-sectional view of a portion of the pouch movement mechanism, showing the region thereof that includes the first linear movement assembly, the second linear movement assembly and the linear lower channel, with the proximate the second end of the first and second helical screws, showing the engagement of the pouch engagement member of the second linear movement assembly and the positioning of the guide channel of the spout within the linear lower channel.
Figure 18:
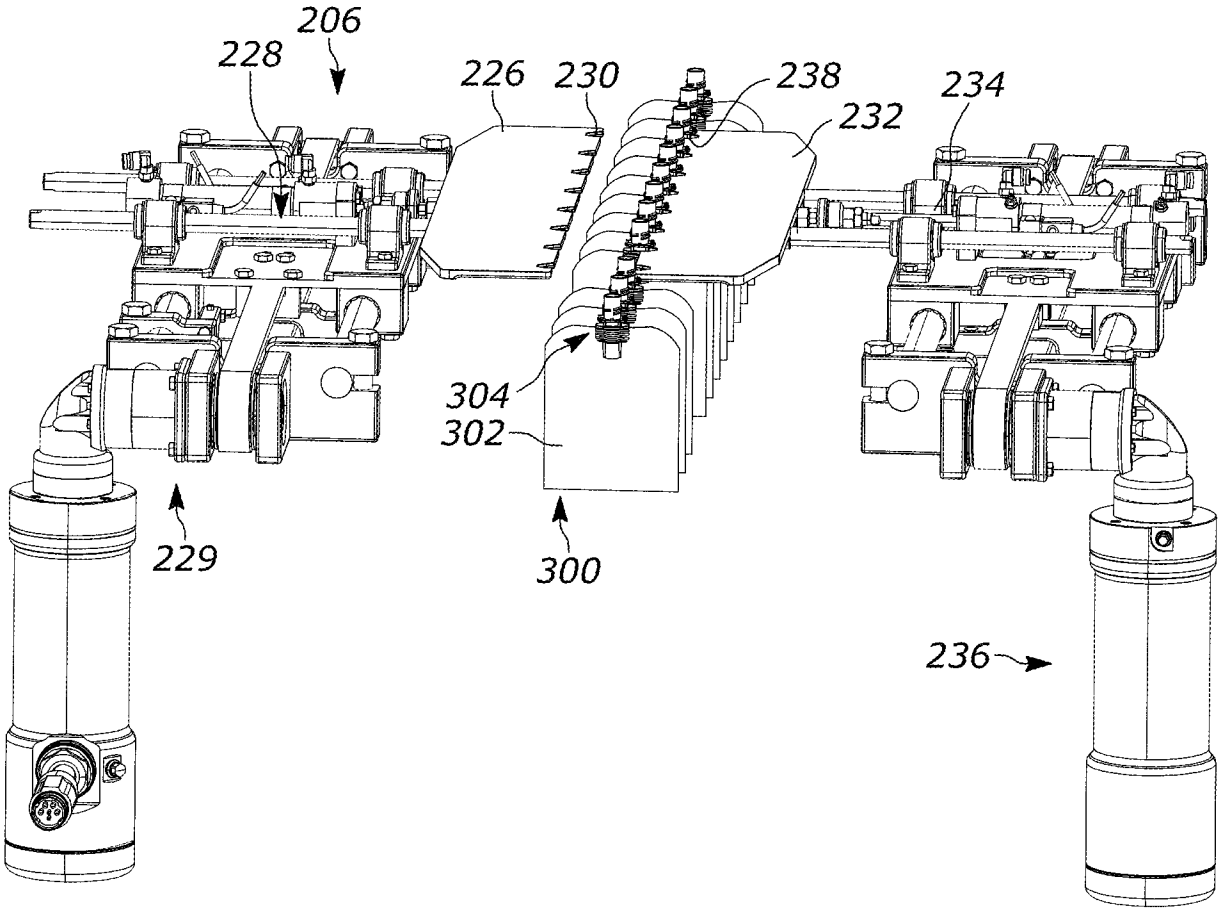
FIG. 18 of the drawings is a perspective view of the region of the pouch movement mechanism that includes the first and second linear movement assemblies, without the linear lower channel, showing engagement between the receiving slots of the pouch engagement member of the second linear movement assembly with the respective ones of the pouch assemblies.

With additional reference to FIGS. 15 and 17, upon filling, the pouch assemblies have reached the second end of the helical screws and are directed into the first end of the linear lower channel. At such time, one of the first and second linear movement assemblies 206, 208 are actuated so as to direct at least one of the pouch engagement members inwardly so as to capture the pouch assembly (and, eventually pouch assemblies) within one of the receiving slots of the pouch engagement member. Once the pouch is received, the respective linear movement assembly is indexed in a direction toward the second end of the linear lower channel to advance the pouch. The linear movement assemblies can be configured to operate sequentially, for example, the first pouch engagement member can engage the pouch assemblies and index the pouch assemblies one movement toward the second end of the linear lower channel. At such time, the second pouch engagement member can engage the pouch assemblies. Once engaged, the first pouch engagement member can disengage from the pouch assemblies and index toward the first end of the linear lower channel. At or about the same time, the second pouch engagement member can index the pouch assemblies toward the second end of the linear lower channel. Next, the first pouch engagement member can then be actuated to engage the pouch assemblies, and, at such time, the second pouch engagement member can disengage. The second pouch engagement member can be indexed back toward the first end of the linear lower channel, while the first pouch engagement member indexes the pouch assemblies toward the second end of the linear lower channel. This process can be repeated over and over to successively move the pouch assemblies as the pouch assemblies reach the second end of the lower channel and are introduced into the linear lower channel, to proceed through the pouch cap zone 29. Thus, while the pouch assemblies are within the pouch cap zone, positive engagement of at least one of the pouch engagement members of the first linear movement assembly and the second linear movement assembly is maintained, thereby substantially precluding undesirable movement of the pouch assemblies within the pouch cap zone.

By transitioning away from the first and second helical screws to the linear movement assemblies, a greater access spout can be provided, so as to facilitate the placement of the cap and the tightening of the cap onto the spout. This is achieved by the use of the linear movement assembly and the transfer of the pouches from the rotating helical screws to the pouch engagement members that can linearly direct the pouch assemblies along the linear lower channel.

With reference to FIG. 14, as the pouch assemblies are indexed beyond the cap feed channel 190, the spout of each pouch assembly sequentially reaches the lower end 192 of the cap feed channel. Through a gravity feed, a cap is positioned at the lower end 192 of the cap feed channel, and as the pouch moves beyond the cap feed channel, the engagement of the spout and the lowermost cap in the cap feed channel at the lower end is disengaged from the cap feed channel and becomes positioned on the spout of the pouch assembly. As the cap is removed from the cap feed channel by the pouch assembly, another cap is gravity fed to the lower end of the cap feed channel and is ready for engagement by and with the subsequent pouch assembly. The caps are sterilized prior to reaching the lower end of the cap feed channel, wherein such sterilization may occur while in the cap feed channel, or prior to positioning into the cap feed channel.

Next, the pouch assemblies having a cap placed on the spout are directed in pairs to the cap twisting assembly by the coordinated movement of at least one of the pouch engagement members 226. Once properly positioned relative to the pouch twisting assembly, the cap twisting assembly is actuated to direct the cap engaging bits 196, 197 to releasably engage the caps that have been positioned on the spouts of the pouch assemblies. Next, the cap engaging bits are rotated by the rotational actuators 198, 199 so as to mate the threads of the cap with the threads of the spout and to tighten the cap onto the spout. Once complete, the pouches are again indexed forward (again in pairs) beyond the second end of the linear lower channel whereupon the pouch assemblies exit the filler assembly. In the configuration shown, an inclined chute is positioned at the second end of the linear lower channel so as to direct, controllably, the filled pouch assemblies from the filler assembly to further processing.

It will be understood that the description above provides a description as to the operation of the configuration shown. And, a number of variations are contemplated, such as, for example, while the pouch assemblies are being shown as being processed in pairs, they may be processed individually or in quantities greater than two. Additionally, multiple lines may run parallel to each other within a single filler assembly. Furthermore, while the timing of each step is generally such that the pouches advance in pairs uniformly, it is contemplated that certain steps may take longer than other steps, and that there may be a dwell time wherein some of the pouch assemblies have been acted upon prior to movement of the pouches within the filler assembly. Other variations are likewise contemplated.

It will further be understood that the upper end of the pouch assembly may be maintained in an aseptic environment throughout the filler assembly wherein an aseptic zone may be defined through each of the pouch sterilization zone, the pouch flush zone, the pouch fill zone and the pouch cap zone. The aseptic environment can be maintained through positive pressure of sterilized air, among other manners. Additionally, the pouch cap can be sterilized prior to direction into the pouch cap zone.

The foregoing description merely explains and illustrates the disclosure and the disclosure is not limited thereto except insofar as the appended claims are so limited, as those skilled in the art who have the disclosure before them will be able to make modifications without departing from the scope of the disclosure.

What is claimed is:

1. A method of utilizing a filler assembly comprising the steps of:

directing a pouch assembly into a pouch preheat zone;

preheating the pouch assembly by directing preheated fluid into the pouch assembly through a preheat nozzle assembly;

applying a vacuum to the pouch assembly after preheating with a preheat vacuum nozzle assembly;

sterilizing the pouch assembly by directing sterilizing fluid into the pouch assembly through a sterilizing nozzle assembly;

applying a vacuum to the pouch assembly after sterilizing with a sterilization vacuum nozzle assembly;

flushing the pouch assembly by directing a flushing fluid into the pouch assembly through a flush nozzle assembly; and applying a vacuum to the pouch assembly after flushing with a flushing vacuum nozzle assembly.

2. The method of claim 1 further comprising the steps of:

allowing preheated fluid to exit the pouch assembly through an outlet of the pouch assembly during the step of preheating;

allowing sterilization fluid to exit the pouch assembly through the outlet of the pouch assembly during the step of sterilizing; and allowing the flushing fluid to exit the pouch assembly through the outlet of the pouch assembly during the step of flushing.

3. The method of claim 1 further comprising the step of:

filling the pouch assembly with a flowable material after the step of applying a vacuum to the pouch assembly after flushing with a flushing vacuum nozzle assembly.

4. The method of claim 3 further comprising the step of:

sterilizing a cap; and applying a cap to the pouch assembly after the step of filling the pouch assembly with a flowable material.

5. A method of utilizing a filler assembly comprising the steps of:

directing a pouch assembly into a pouch sterilization zone;

sterilizing the pouch assembly by directing sterilizing fluid into the pouch assembly through a sterilizing nozzle assembly;

applying a vacuum to the pouch assembly after sterilizing with a sterilization vacuum nozzle assembly;

flushing the pouch assembly by directing a flushing fluid into the pouch assembly through a flush nozzle assembly; and applying a vacuum to the pouch assembly after flushing with a flushing vacuum nozzle assembly.

6. The method of claim 5 further comprising the step of applying a vacuum to the pouch assembly prior to the step of sterilizing the pouch assembly.

7. The method of claim 5 further comprising the step of:

allowing sterilization fluid to exit the pouch assembly through the outlet of the pouch assembly during the step of sterilizing.

8. The method of claim 5 further comprising the step of:

allowing the flushing fluid to exit the pouch assembly through the outlet of the pouch assembly during the step of flushing.

9. The method of claim 5 wherein the step of sterilizing the pouch assembly comprises the steps of:

sterilizing the pouch assembly a first time by directing sterilizing fluid into the pouch assembly through a sterilizing nozzle assembly; and sterilizing the pouch assembly a second time by directing sterilizing fluid into the pouch assembly through a sterilizing nozzle assembly.

10. The method of claim 9 further comprising the steps of:

allowing sterilization fluid to exit the pouch assembly through the outlet of the pouch assembly during the step of sterilizing the pouch assembly a first time; and allowing sterilization fluid to exit the pouch assembly through the outlet of the pouch assembly during the step of sterilizing the pouch assembly a second time.

11. The method of claim 5 further comprising the step of:

filling the pouch assembly with a flowable material after the step of applying a vacuum to the pouch assembly after flushing with a flushing vacuum nozzle assembly.

12. The method of claim 11 further comprising the step of:

sterilizing a cap; and applying a cap to the pouch assembly after the step of filling the pouch assembly with a flowable material.

13. A method of utilizing a filler assembly comprising the steps of:

directing a pouch assembly into a pouch sterilization zone;

sterilizing the pouch assembly by directing sterilizing fluid into the pouch assembly through a sterilizing nozzle assembly;

applying a vacuum to the pouch assembly after sterilizing with a sterilization vacuum nozzle assembly;

flushing the pouch assembly by directing a flushing fluid into the pouch assembly through a flush nozzle assembly;

applying a vacuum to the pouch assembly after flushing with a flushing vacuum nozzle assembly;

filling the pouch assembly with a flowable material after the step of applying a vacuum to the pouch assembly after flushing with a flushing vacuum nozzle assembly;

sterilizing a cap; and applying a cap to the pouch assembly after the step of filling the pouch assembly with a flowable material.

14. The method of claim 13 further comprising the steps of:

allowing sterilization fluid to exit the pouch assembly through the outlet of the pouch assembly during the step of sterilizing.

15. The method of claim 14 further comprising the steps of:

allowing the flushing fluid to exit the pouch assembly through the outlet of the pouch assembly during the step of flushing.

16. The method of claim 15 wherein prior to the step of directing a pouch assembly into a pouch sterilization zone, the method further comprises the steps of:

directing a pouch assembly into a pouch preheat zone; and preheating the pouch assembly by directing preheated fluid into the pouch assembly through a preheat nozzle assembly.

17. The method of claim 16 further comprising the step of:

allowing preheated fluid to exit the pouch assembly through the outlet of the pouch assembly during the step of preheating.

18. The method of claim 17 further comprising the step of:

applying a vacuum to the pouch assembly after the step of preheating.

* * * * *